US007821527B2

(12) United States Patent
Horike et al.

(10) Patent No.: US 7,821,527 B2
(45) Date of Patent: Oct. 26, 2010

(54) IMAGE FORMING APPARATUS

(75) Inventors: Masanori Horike, Kanagawa (JP); Yasuo Katano, Kanagawa (JP); Masanori Saitoh, Tokyo (JP); Nobuaki Kondoh, Kanagawa (JP); Shin Kayahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 259 days.

(21) Appl. No.: 12/187,826

(22) Filed: Aug. 7, 2008

(65) Prior Publication Data

US 2009/0041492 A1 Feb. 12, 2009

(30) Foreign Application Priority Data

Aug. 9, 2007 (JP) ..... 2007-208545
Aug. 9, 2007 (JP) ..... 2007-208599

(51) Int. Cl.
*B41J 2/385* (2006.01)
*B41J 2/06* (2006.01)
*G03G 13/04* (2006.01)
*G03G 9/08* (2006.01)

(52) U.S. Cl. ..... 347/140; 347/155; 399/55

(58) Field of Classification Search ..... 347/55, 347/101, 103, 140, 155–156, 158, 212; 430/124.1, 430/124.21, 124.22; 399/55, 67, 110, 11, 399/119, 237, 252, 262, 325, 339, 340–341
See application file for complete search history.

(56) References Cited

U.S. PATENT DOCUMENTS 6,157,797 A 12/2000 Saito et al.
6,215,974 B1 4/2001 Katoh et al.
6,256,461 B1 7/2001 Takeyama et al.
6,292,641 B1 9/2001 Takeyama et al.
6,597,884 B2 7/2003 Miyaguchi et al.
6,674,982 B2 1/2004 Saitoh et al.
6,901,231 B1 5/2005 Sakai et al.
6,941,098 B2 9/2005 Miyaguchi et al.
6,947,700 B2 9/2005 Kurotori et al.
7,024,142 B2 4/2006 Sakai et al.
7,046,952 B2 5/2006 Kurotori et al.
7,062,204 B2 6/2006 Miyaguchi et al.
7,082,274 B2 7/2006 Saitoh et al.
7,123,864 B2 10/2006 Miyaguchi et al.

(Continued)

FOREIGN PATENT DOCUMENTS

JP 59-181370 10/1984

(Continued)

*Primary Examiner*—K. Feggins
(74) *Attorney, Agent, or Firm*—Oblon, Spivak, McClelland, Maier & Neustadt, L.L.P.

(57) ABSTRACT

An image forming apparatus, which reduces toner spatter and produces a good quality image when forming a toner image using the direct recording method. An image forming part includes: a toner carrier for carrying toner; and toner controlling means, which is disposed between the toner carrier and recording paper on which the toner is made to adhere, and which has a plurality of toner passage holes, the toner controlling means having a control electrode for controlling the passage of toner on the toner carrier side surface in the area around the toner passage hole, and forming a toner image by causing the toner to fly to the recording paper, and the image forming apparatus having liquid applying/humidifying means for either applying a liquid to or humidifying the imaging surface of the recording paper prior to forming a toner image.

16 Claims, 30 Drawing Sheets

U.S. PATENT DOCUMENTS

| | | | | |
|---|---|---|---|---|
| 7,187,892 | B2 | 3/2007 | Horike et al. | |
| 7,236,720 | B2 | 6/2007 | Nakazato et al. | |
| 7,655,374 | B2 * | 2/2010 | Katano et al. | 430/124.1 |
| 7,689,145 | B2 * | 3/2010 | Nakamura et al. | 399/110 |
| 2004/0197122 | A1 | 10/2004 | Nakano et al. | |
| 2006/0045572 | A1 * | 3/2006 | Hongawa et al. | 399/237 |
| 2006/0251449 | A1 | 11/2006 | Takahashi et al. | |

FOREIGN PATENT DOCUMENTS

| | | |
|---|---|---|
| JP | 63-136058 | 6/1988 |
| JP | 2-226261 | 9/1990 |
| JP | 2-52260 | 11/1990 |
| JP | 2933930 | 5/1999 |
| JP | 11-301014 | 11/1999 |
| JP | 2001-505146 | 4/2001 |
| JP | 3290513 | 3/2002 |
| JP | 2004-109747 | 4/2004 |
| JP | 2007-219105 | 8/2007 |

* cited by examiner

IMAGE FORMING APPARATUS

BACKGROUND OF THE INVENTION

1. Field of the Invention

The present invention relates to an image forming apparatus, and more particularly to an image forming apparatus that forms an image by causing a toner, which has been made to fly from a toner carrier, to fly and adhere to recording medium means by way of toner passage holes the opening and closing of which is controlled.

2. Description of the Related Art

An image forming apparatus of the type that directly records an image on a recording medium (comprising an intermediate transfer medium) using toner (recording material), which is called toner jet, direct toning, toner projection and the like, is known as a conventional image forming apparatus.

For example, Japanese Patent Laid-open No. 63-136058 (referred to as Prior Art 1) discloses an image forming apparatus that uses frictional electrification between either fixed plates or rotating rollers to apply an electrification charge to toner supplied from a toner hopper, and after rotational feeding, controls the flight of the toner with an electric field between a control pulse applied to a control member and the rotating rollers. Toner having an electrification charge is electrostatically adhered to the surface of the rotating roller here, and this toner must be separated using a control pulse. This is problematic in that, since there is a gap of several hundred micrometers or more between the rotating roller and the control member, the control pulse applied for separation must inevitably have a high voltage of 500V or more, and the cost of the driver needed to control the number of picture elements is extremely expensive. Another problem is poor responsiveness and time delays associated with causing the toner adhered to the rotating roller to separate and fly.

Further, Japanese Patent No. 2933930 (referred to as Prior Art 2) and Japanese Patent Publication No. 2-52260 (referred to as Prior Art 3) disclose an image forming apparatus that applies a control pulse to a control electrode through which the developer passes, while applying an alternating bias between a rotating developer support and control means. Although this constitution alleviates the problem of responsiveness associated to the apparatus disclosed in the above-mentioned Prior Art 1, a uniform alternating field is applied to the entire flying area of the toner, repeating the time that the developer is adhered to the developer support and the flying state. For this reason, a strong alternating bias must be applied for separating the developer that is adhered to the developer support, causing a major reliability problem in that there is no way to avoid the separated toner flying with great force to the control means side, and large amounts of developer adhering to the control means electrode. Furthermore, this constitution cannot solve the problem of driver cost since the same gap as mentioned hereinabove exists between the developer support and the control means, and a high voltage value of 500V or more is applied between the two, requiring that the control pulse that forms the field that either passes or blocks the developer to/from this field be a similarly high voltage value.

Conversely, Japanese Patent Laid-open No. 59-181370 (referred to as Prior Art 4) discloses a constitution, which has a plurality of electrodes in a developer carrier, and causes the toner to fly to the control electrode side by forming a temporally changing electric field between these electrodes. Since the passage of toner that is flying and floating in the proximity of the control electrode is controlled here, the problem of the high control voltage of the apparatuses of Prior Art 1 through Prior Art 3 is resolved.

Further, Japanese Patent Laid-open No. 02-226261 (referred to as Prior Art 5), similar to the above Prior Art 4, discloses a constitution, which has a plurality of electrodes in a developer carrier, and which causes the toner to fly by forming a temporally changing electric field between these electrodes, and a control electrode for controlling the passage of the toner, which had heretofore been installed on the recording medium side, is installed on the toner supply side. It is disclosed that in this constitution, the control voltage, which had to be 400V in the conventional apparatus, can be 100V, and when the toner that adheres to the print head, on which the control electrode is provided, is removed, this toner can be returned to the toner supply source.

Further, Japanese Patent National Phase Publication No. 2001-505146 (referred to as Prior Art 6) discloses a constitution, which uses a rotating cylindrical sleeve to supply toner, and which applies a static electric force that allows the toner to pass through an aperture via a uniform electrical field between the print head surface potential and the sleeve, provides a deflecting electrode that is paired on the print head surface side with the control electrodes surrounding the aperture, and raises the print dot density in the main scanning direction. It is disclosed that a guard electrode is disposed between the control electrodes that control the passage of the toner here to prevent interaction between the control fields.

Further, Japanese Patent Laid-open No. 11-301014 (referred to as Prior Art 7) discloses the disposition of a control electrode, which supplies toner via a toner supply roller, and which controls the flight of the toner on the toner supply roller side of the aperture containing member, and a deflecting electrode, which deflects the flight path of the toner.

Conversely, Japanese Patent No. 3290513 (referred to as Prior Art 8) discloses that after forming a toner image on the surface of the recording paper, a fixing agent is either sprayed or dripped onto the recording paper surface to affix the toner to the recording paper by either dissolving or swelling the toner. Further, Japanese Patent Laid-open No. 2004-109747 (referred to as Prior Art 9) discloses that the toner is affixed by applying a dissolving agent only to the toner image part of the carrier surface of a toner image formed using a water-repelling intermediate transfer unit. These Prior Arts are both systems for producing an output image by developing, transferring and fixing toner to an image carrier that forms a conventional latent image, and are fixing techniques that do not require high heating energy. However, the constitution of Prior Art 8 has a major drawback in that it is difficult to control the micro amounts of fixing agent applied to the recording paper, giving rise to wrinkling and curling of the recording paper. Further, although Prior Art 8 resolves the problem of wrinkling and curling in particular by applying a foam fixing solution to the toner of the intermediate transfer unit, there is no disclosure about controlling the amount of the foam fixing solution that is applied.

Thus, a conventional direct recording-type image forming apparatus has problems, such as the fact that the toner adheres to the surface of toner controlling means and around the toner passage holes, the ON/OFF control of the passage of the toner cannot be stably controlled, and toner utilization efficiency is inadequate.

In addition, the problem right from the start is that in an apparatus in which a direct recording method forms an image by adhering toner to the imaging surface of recording medium means, when the toner collides with the imaging surface, the toner spatters and decreases the image quality.

SUMMARY OF THE INVENTION

With the foregoing in mind, it is an object of the present invention to provide an image forming apparatus that reduces toner spatter when forming a toner image using a direct recording method, and also promotes toner fixing to produce good quality images.

In an aspect of the present invention, an image forming apparatus comprises a toner carrier for carrying toner; a recording medium device to which the toner is made to adhere; and a toner controlling device which is disposed between the toner carrier and the recording medium device, and which has a plurality of toner passage holes. A control electrode for controlling the passage of the toner is disposed at least in either an area around the toner passage hole or on an inner wall of the hole on the surface of the toner carrier side of the toner controlling means. The image forming apparatus further comprises a bias voltage applying device for bias voltage application is disposed on the recording medium device side of the toner controlling device so that the toner, which has passed through the toner controlling device, is made to adhere to the recording medium device. The image forming apparatus further comprises a liquid applying device for applying to the recording medium device an application liquid containing a softening agent for softening the toner by either dissolving or swelling a resin in the toner prior to forming a toner image on the recording medium device.

In another aspect of the present invention, an image forming apparatus comprises a toner carrier for carrying toner; a recording medium device which the toner is made to adhere; and a toner controlling device which is disposed between the toner carrier and the recording medium device, and which has a plurality of toner passage holes. A control electrode for controlling the passage of the toner is disposed at least in either an area around the toner passage hole or on an inner wall of the hole on a surface of a toner carrier side of the toner controlling means. The image forming apparatus further comprises a bias voltage applying device for bias voltage application is disposed on the recording medium device side, so that the toner, which has passed through the toner controlling device, is made to adhere to the recording medium device. The image forming apparatus further comprises a device for either applying a liquid to or humidifying the recording medium device prior to forming a toner image on the recording medium device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Prior to explaining the present invention, the prior art of the present invention and the problems associated therewith will be explained by referring to the figures.

Figure 1:
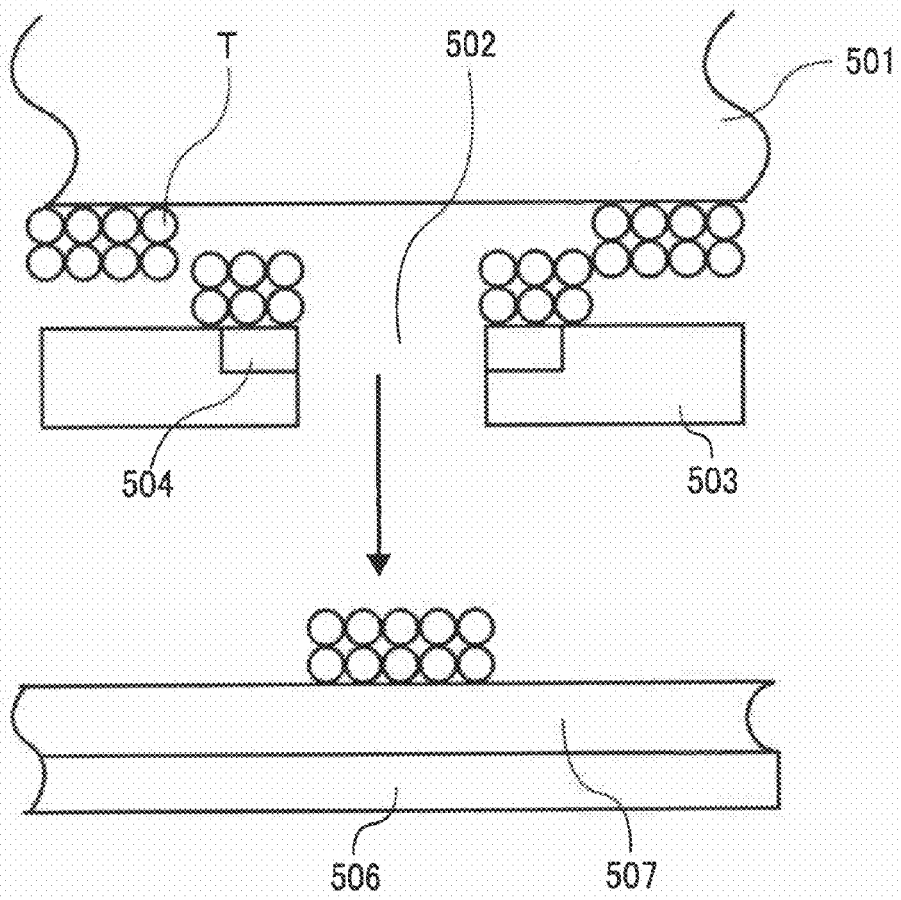
FIG. 1 PRIOR ART
FIG. 1 is a diagram schematically showing the basic constitution of a conventional direct recording method apparatus.

The basic constitution for forming an image using the conventional direct recording method, for example, is constituted as shown in FIG. 1. In FIG. 1, a toner carrying roller 501 is disposed as an agent carrier such that its axis extends in the left-right direction in the figure, and carries charged toner T on its surface while being rotationally driven by driving means not shown in the figure. A flexible printed board 503 is disposed below this toner carrying roller 501 as a hole forming member for forming a plurality of holes 502. The FPC 503 comprises a plurality of flight electrodes 504 in a ring shape formed opposite the toner carrying roller 501 so as to surround the respective holes 502.

Then, down below the above-mentioned FPC 503, there are disposed a counter electrode 506 that faces the toner carrying roller 501 by way of this FPC 503, and a recording paper 507 that is conveyed via conveying means on top of this counter electrode 506. Furthermore, for the sake of convenience, only one each of the holes 502 and flight electrodes 504 are shown in FIG. 1, but in actuality, a plurality of combinations of these holes 502 and flight electrodes 504 are formed in the FPC 503. More specifically, for example, in a 600 dpi FPC 503, 4960 combinations of these holes 502 and flight electrodes 504 are formed.

Accordingly, the toner carrying roller 501, for example, is in a grounded state, and carries on its surface toner T, which is charged to minus polarity. When a plus polarity flight voltage is applied to the above-mentioned flight electrode 504, an electric field of a prescribed strength acts on the toner T located opposite the flight electrode 504 on the toner carrying roller 501, and on the toner T in the vicinity thereof. An electrostatic force applied to the toner T in accordance with the effect of this field exceeds the adhesive force between the toner T and the toner carrying roller 501, and an aggregate of toner T selectively flies from the toner carrying roller 501 in the shape of a dot, and enters inside a hole 502.

Then, the dot-shaped aggregate of toner T continues to fly pulled by an electric field formed between the flight electrode 504 and the above-mentioned counter electrode 506, which takes on a higher electric potential than this flight electrode 504, passes through the hole 502 and adheres to the surface of the above-mentioned recording paper 507. In accordance with this adherence, the toner T aggregate becomes a dot image.

In this case, respective specialized ICs must individually control the ON/OFF of the flight voltage for the respective flight electrodes 504. That is, in a direct recording type image forming apparatus, the same number of expensive ICs as the number of flight electrodes 504 is needed when the voltage is high. For example, when using a 600 dpi FPC 503, 4960 expensive switching elements must be provided. Generally speaking, an IC becomes more expensive the higher the withstand voltage thereof due to the greater chip surface area required, and in a direct recording type image forming apparatus, the extent to which the control voltage can be lowered becomes an important element in the effort to lower the cost of the apparatus.

However, adhesive forces that attract one another as a result of image force, van der Waals forces, liquid bridging force and so forth act on the toner T and toner carrying roller 501, and this prevents the flight voltage from being lowered. As a result of this, it is necessary to apply at least 500V or more of flight voltage in the apparatus shown in FIG. 1.

By contrast, it is possible to lower the voltage applied to the flight electrode by employing a constitution, like that disclosed in the above-mentioned Prior Art 4, which has a plurality of electrodes on the developer carrier, forms a temporally changing electric field between these electrodes, makes the toner into a cloud, and causes the toner to fly to the control electrode side.

However, the problem is that because the toner is made to fly by generating a strong electric field via the reciprocal application of electric potential differences between the plurality of micro-pitch electrodes provided on the developer carrier, the flying toner adheres to the surface of the control electrode and the toner accumulates, and the toner also adheres to the circumferences of the holes through which the toner passes, over time causing the amount of toner passing through these holes to fluctuate and raising the likelihood of fluctuations occurring in image density.

Further, the toner cloud, which flies from the surface of the developer carrier, is distributed height-wise, and toner that passes through toner passage holes by simply applying a control pulse to the control electrode results in poor utilization efficiency, making it difficult to assure printing speed. Another problem is that the adherence of the toner cloud is not limited to the control electrode, which continuously utilizes this toner in a static state, but rather the toner cloud also adheres to and accumulates on the members surrounding this control electrode. As a result, the electric potentials of all the members that form the control electrode rise to electric potentials in the direction corresponding to the charging polarity of the toner, acting on the flight of the toner from the surface of the developer carrier as a reverse bias field and resulting in lower flight efficiency.

The embodiments of the present invention will be explained below by referring to the accompanying figures.

First, an image forming apparatus related to a first embodiment of the present invention will be explained by referring to FIG. 2.

This image forming apparatus comprises an image forming part 102 for forming an image using the direct recording method by causing toner to fly and adhere to a recording paper 101, which is recording medium means; a paper conveying belt 103 for conveying the recording paper 101 to the image forming part 102; liquid applying means 104 for applying to the recording paper 101 an application liquid that contains a softening agent for softening the above-mentioned toner by either dissolving or swelling the resin comprised in the toner relative to the recording paper 101 at the upstream side of the image forming part 102, that is, prior to forming a toner image on the recording paper 101; a fixing unit 105 for melting and fixing a toner image formed on the recording paper 101 by the image forming part 102; and a pair of conveying rollers 106, conveying guides 107 through 109 and so forth for conveying the recording paper 101.

The image forming part 102 comprises a toner carrier 1 for carrying charged toner T; a toner supplying roller 112 for supplying toner T to the toner carrier 1; a supply unit 111 comprising a blade 113 that controls the thickness of the toner on the toner carrier 1; toner controlling means 4, which lies between the image forming part 102 and the recording paper 101 that is recording medium means, and which comprises a toner passage hole 41, a control electrode 42, and a common electrode 43; and a back electrode 31, which is disposed on the back side of the recording paper 101, and which is bias voltage applying means via which a bias voltage is applied, and forms a direct image on the recording paper 101 by selectively causing toner cloud T on the toner carrier 1 to fly through the toner passage hole 41 of toner controlling means 4 by which ON/OFF is controlled, and adhere to the recording paper 101 to which a bias voltage has been applied in accordance with the image to be formed on the recording paper 101.

Furthermore, the paper conveying belt 103 is suspended around two rollers 121, 122, moves in a revolving manner in the direction of the arrows, and electrostatically clamps, holds and conveys the recording paper 101 by being charged by a charging roller or other such charging means not shown in the figure.

In a direct recording type image forming part 102 like this, in order to assure sufficient print image density and increase the printing speed, it is necessary to assure the amount of toner that passes through the toner passage hole 41 of toner controlling means 4, and to raise the speed of the toner that will pass through this toner passage hole 41 and the speed of the toner after this toner has passed through the toner passage hole 41 until the toner reaches the imaging surface (the surface of recording medium means). For this reason, there occurs the characteristic problem of the toner spattering upon colliding with the surface of recording medium means (imaging surface). In particular, when the flying speed of the toner upon reaching recording medium means exceeds 1 m/s, and constitutes between 2 m/s and 4 m/s, the kinetic energy at collision is great, the toner bounds on the surface of recording medium means and spatters onto the surrounding areas, lowering image quality. This toner spatter is more conspicuous the larger the diameter of the toner particle, and the lower the ambient humidity.

Accordingly, in this image forming apparatus, an application liquid, which contains a softening agent for softening the toner by either dissolving or swelling the resin comprised in the toner relative to the surface of the recording paper 101, which is recording medium means, is applied to the surface of the recording paper 101 (imaging surface) using liquid applying means 104 prior to forming a toner image by controlling the passage of the toner via toner controlling means 4. Furthermore, liquid applying means 104 will be described in detail further below.

Consequently, the application liquid, which contains a softening agent, is applied beforehand to the surface of the recording paper 101, which is recording medium means (imaging surface), the humidity of the imaging surface rises, the adhesive force between the toner and the imaging surface increases when the toner collides with the imaging surface, toner spatter is suppressed and reduced, and the repulsive force of the imaging surface at toner collision is simultaneously reduced, and toner spatter is lessened due to this fact as well. Furthermore, the fixing of the toner to the recording medium means (imaging surface) is promoted by either dissolving or swelling the resin in the toner using the softening agent contained in the application liquid, the heat energy required for heat fixing is greatly reduced, and applying a sufficient amount of application liquid can do away with the need for heat energy all together, making it possible to fix the toner using pressure alone. That is, a low power fixing unit can be used as the fixing unit 105, or a fixing unit that only applies pressure can be used as the fixing unit 105.

Thus, by comprising liquid applying means for applying an application liquid that contains a softening agent for softening the toner by either dissolving or swelling the resin in the toner relative to recording medium means prior to forming a toner image using the direct recording method, the present invention reduces toner spatter when forming a toner image using the direct recording method, thereby also promoting toner fixing and producing a good quality image.

Figure 3:
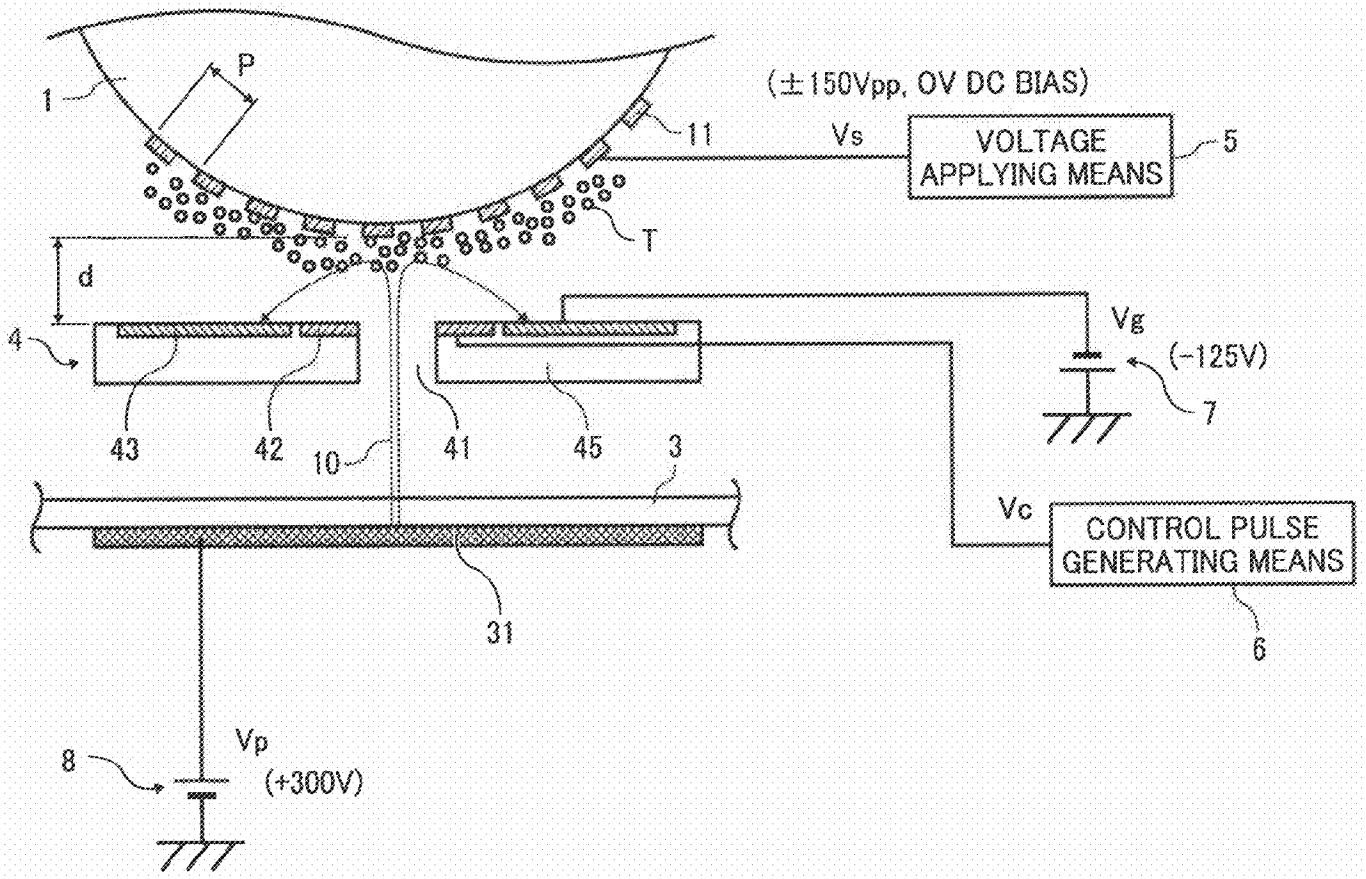
FIG. 3 is a diagram showing the constitution of a first example of the image forming part of this image forming apparatus.

Next, first example of the constitution of the image forming part 102 constituting the image forming apparatus related to the present invention will be explained by referring to FIG. 3.

This image forming part comprises a roller-shaped toner carrier 1 that causes the toner T to fly and carries the toner cloud; recording medium means 3 (for example, the above-mentioned recording paper 101 or an intermediate transfer recording medium or the like) to which the toner T adheres; and toner controlling means 4 that has a plurality of toner passage holes 41 disposed between the toner carrier 1 and recording medium means 3.

The toner carrier 1 has a plurality of electrodes 11, which is provided at a prescribed pitch by being formed at prescribed intervals in the direction (the circumferential direction here) in which the toner T is being conveyed relative to the surface side along a direction (the axial direction here) that is orthogonal to the toner T conveying direction, and a pulse voltage (clouding pulse) of an average potential Vs, the electric potential of which differs according to time, is applied from voltage applying means 5 to the respective electrodes 11 of this toner carrier 1. Consequently, this constitutes means for clouding the toner T.

For example, a pulse voltage of a frequency between 0.5 KHz and 7 KHz is applied, and since the interval of the respective electrodes 11, 11 is provided at a fine pitch, a strong electric field is formed between the electrodes 11, 11. Thus, the toner T is made to fly with great force from the surface of the electrode 11, which has an electric potential that repulses the charge polarity of the toner T, and the flying toner T is drawn to the electrode 11 to which is being applied an attraction polarity potential, and switching the pulse causes the toner T to repeatedly fly in the up-down direction in accordance with the frequency of the pulse, causing the toner T to transition to a cloud state. Furthermore, toner T, which flies up high in a high pulse frequency region, can also fly further upward prior to returning to the surface of the electrode 11 if the pulse is switched while the toner T is in flight.

Toner controlling means 4 is provided with a plurality of toner passage holes (openings) 41 through which the toner T is able to pass, and ring-shaped control electrodes (also called discrete control electrodes, or discrete electrodes) 42 are individually disposed relative to the respective toner passage holes 41 in the areas surrounding the respective toner passage holes 41 of the toner supply side surface (surface of the toner carrier 1 side) of this toner controlling means 4, and, in addition, a common electrode 43 that is common to a plurality of toner passage holes 41 is provided relative to the toner passage holes 41 via an insulation region on the external side of the control electrodes 42. Furthermore, "common" signifies that the same electric potential is applied, and that the electrodes are electrically connected.

Figure 4:
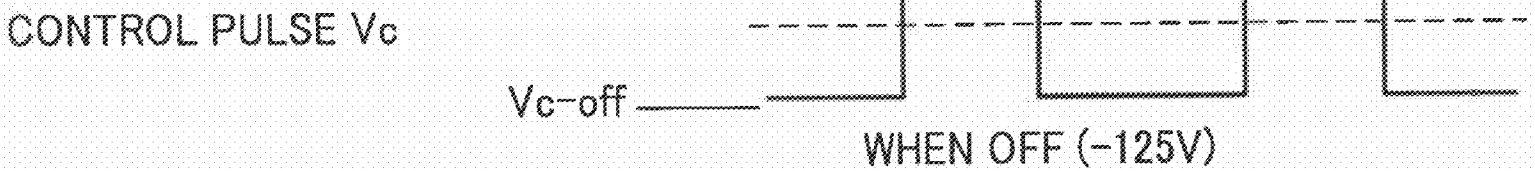
FIG. 4 is a diagram showing an example of a control pulse that is applied to a control electrode.

A control pulse Vc, like that shown in FIG. 4 for example, is applied from control pulse generating means 6 to a control electrode 42 of this toner controlling means 4. In this case, when setting the toner passage hole 41 to the toner T passage-enabled state (ON state), a voltage Vc-on is applied to the control electrode 42, and when setting the toner passage hole 41 to the toner T passage-disabled state (OFF state), a voltage Vc-off is applied to the control electrode 42. Further, a voltage Vg is applied to the common electrode 43 from a constant powering means 7. The control electrode 42 of toner controlling means 4 is only able to operate in the area surrounding the toner passage hole 41, but this control electrode 42 can also be disposed either on the inner wall surface of the toner passage hole 41 or on both the internal surface and the area surrounding the toner passage hole 41 on the toner carrier 1 side.

On the side of recording medium means 3, a back electrode 31 is disposed as electrode means that constitute bias voltage applying means by which a bias voltage is applied to the back side of recording medium means 3 so that the toner T that has passed through toner controlling means 4 adheres to recording medium means 3, and a bias voltage Vp from bias powering means 8 is applied to make the toner T that has passed through toner controlling means 4 adhere to recording medium means 3. This recording medium means 3 can be an intermediate transfer recording medium, on which an image is formed one time and transferred to paper thereafter, or a recording paper. The application of a bias voltage Vp to this recording medium means 3, for example, can use a constitution that disposes a back electrode 31 on the back side of recording medium means 3 (the side face opposite to the toner carrier 1) and causes recording medium means 3 to pass along the upper surface of this back electrode 31, and in the case of an intermediate transfer recording medium, a constitution that embeds an electrode inside this intermediate transfer recording medium (a constitution that makes the electrode on the recording medium means side an internal electrode), or a constitution that disposes the back electrode 31 on the back of the intermediate transfer recording medium.

This embodiment comprises a plurality of electrodes 11 disposed on the surface of the toner carrier 1 as means for clouding the toner on the surface of the toner carrier 1, and applies a pulse voltage of average potential Vs to the respective electrodes 11. At this time, the toner carrier 1 and toner controlling means 4 are disposed in a relationship ($p<d$) in which the distance d between the surface of the toner carrier 1 and the toner controlling means 4 side of the toner carrier 1 (signifies the surface of the toner carrier 1 side) becomes larger relative to a two-phase inter-electrode pitch p, which applies voltages in a relationship that causes the toner T to repeatedly fly in an alternating manner in the attraction direction and the repulsion direction between adjacent electrodes 11 (or an n-phase inter-electrode pitch, which applies n-phase voltage to the respective electrodes 11 every n electrodes).

That is, this is because, in the $p>d$ relationship, the flight fields formed on the surfaces of the electrodes 11 of the toner carrier 1 interfere with the ON/OFF field of the toner controlling means 4 side of the toner carrier 1 surface, and disturbs the loop field of toner controlling means 4, which will be described further below. Thus, the toner readily adheres to the surface of a control electrode 42. In the $p<d$ condition, toner adherence to the control electrodes 42 can be reliably prevented, the density of continuously imaged dots does not change, and a good image is produced.

Figure 5B:
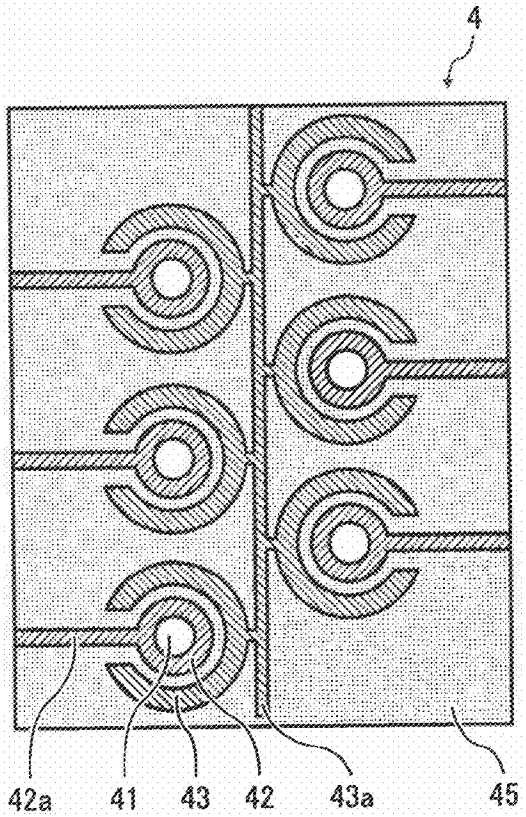
FIG. 5B is a diagram showing the toner supply side of an example of toner control means.
Figure 5A:
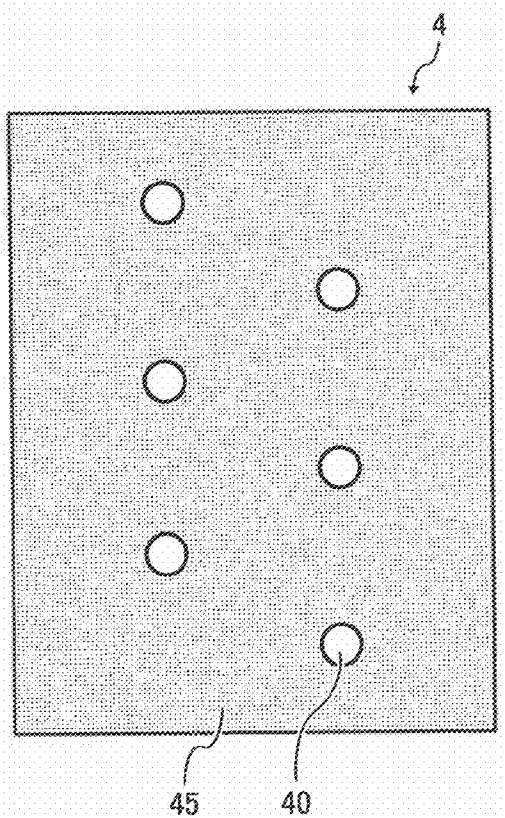
FIG. 5A is a diagram showing the imaging surface side of an example of toner control means.

Next, an example of a specific constitution of toner control means 4 will be explained by referring to FIGS. 5A and 5B. Furthermore, FIG. 5A shows the imaging surface side of toner controlling means 4, and FIG. 5B shows the surface of the toner supplying side.

This example is a constitution, which disposes a 10 μm- to 100 μm-wide ring-shaped control electrode 42 so as to surround a toner passage hole 41 on the surface of the toner supplying side (toner carrier 1 side) of an insulating board (base material) 45, and disposes a common electrode 43, which applies a common bias voltage Vg to a plurality of toner passage holes 41, on the same surface as the control electrode 42 at a spacing of between 20 μm to 50 μm from this control electrode 42, that is, by way of an insulating region formed in the insulating base board 45.

The toner passage hole 41 is determined by the size of the dot to be formed, and has a diameter of between ϕ30 μm and ϕ150 μm. The control electrode 42 is connected to a lead pattern 42*a* for connecting to a driver circuit (drive circuit) for individually controlling the ON/OFF of toner T passage, and the common electrode 43 is connected to a common lead pattern 43*a*. Further, the imaging surface side (surface on recording medium means 3 side) of the insulating board 45 is in a state in which the toner passage hole 41 is open.

Thus, making the constitution such that the common electrode of toner controlling means is a shape that surrounds the external side of a control electrode in a ring shape by way of an insulating area enables the formation of an electric force that forms between recording medium means side bias potential and the common electrode on the external side of the control electrode, thereby eliminating the occurrence of mutual interference (receiving the affects of other toner passage holes) when there is a multi-driver (a driver that causes toner to fly from a plurality of nozzle passage holes).

Further, forming the control electrode and common electrode of toner controlling means on the same surface makes it possible to form these electrodes at the same time in a single manufacturing process, enabling the production of precision, low-cost electrodes.

Figure 6B:
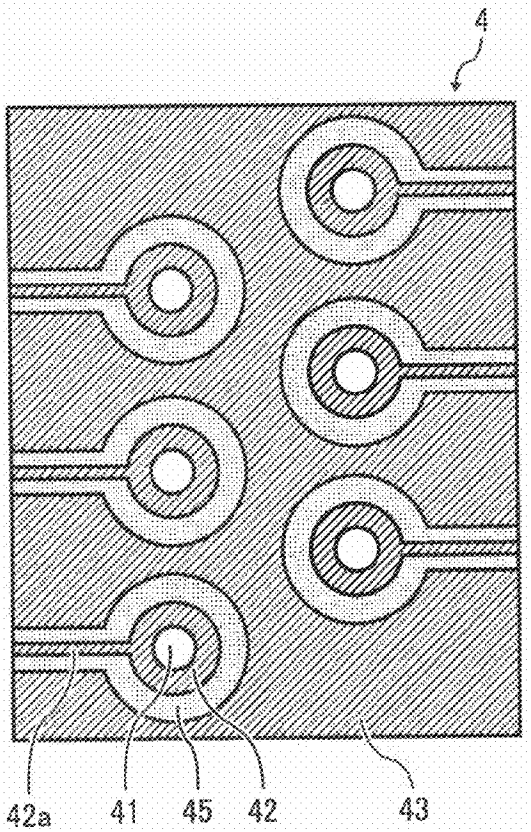
FIG. 6B is a diagram showing the toner supply side of the other example of toner control means.
Figure 6A:
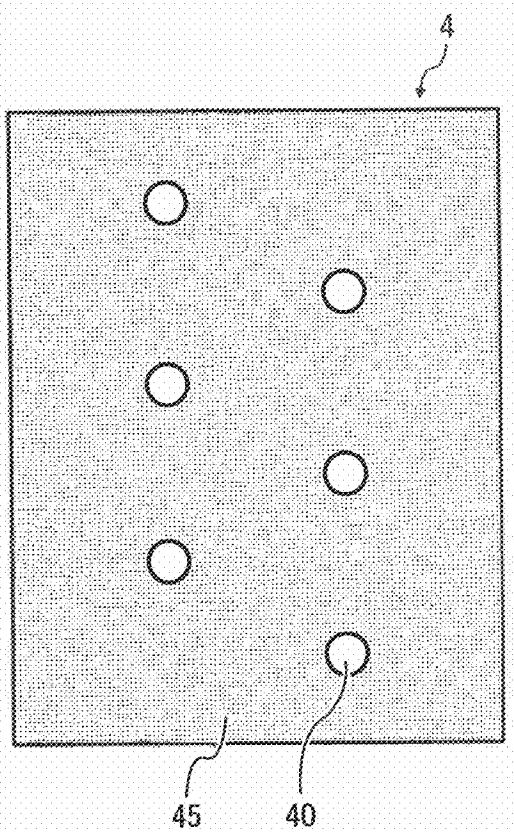
FIG. 6A is a diagram showing the imaging surface side of another example of toner control means.

Another example of a specific constitution of toner controlling means 4 will also be explained by referring to FIGS. 6A and 6B. Furthermore, FIG. 6A shows the imaging surface side of toner controlling means 4, and FIG. 6B shows the surface of the toner supplying side.

This example uses a constitution, which disposes a 10 μm- to 100 μm-wide ring-shaped control electrode 42 so as to surround a toner passage hole 41 on the surface of the toner supplying side (toner carrier 1 side) of an insulating board (base material) 45, and disposes a common electrode 43, which applies a common bias voltage Vg to a plurality of toner passage holes 41, in a solid shape so as to cover the entire open space, leaving a space for an insulating region of 20 μm to 50 μm from this control electrode 42.

Thus, a constitution such that the common electrode of toner controlling means is disposed in a solid shape by way of an insulating region on the external side of the control electrode, that is, forming the common electrode to cover the entire region on the external side of the control electrode makes it possible to shield the bias potential field of the recording medium means side, and to reduce toner adherence to the control electrode and enhance toner utilization efficiency.

From the aspects of costs and manufacturing processes, a specific manufacturing method for toner controlling means 4 like this will use a resin film, for example, a polyimide, PET, PEN, PES or the like, at a thickness of between 30 μm and 100 μm as the insulating member, which is the base material 45, and will first use vapor deposition to form a 0.2 μm- to 1 μm-thick Al film on the surface of the resin film. Next, in a photolithography process, a photoresist will be applied using a spinner, after which pre-bake and mask exposure processes will be carried out, then subsequent to development, the photoresist will be thermally hardened, and thereafter Al patterning will be performed using an Al etching solution. When electrode patterning is required on the reverse side of the film, the same processes as those mentioned above can be used, but a pattern to be used as a mask for drilling holes can be formed on the reverse side. The formation of through-holes, which will constitute the toner passage holes 41, can be high-precision hole processing with no displacement or misregistration using either a mechanical pressing process subsequent to patterning, or excimer laser processing that makes use of a pattern formed on the reverse side, or a dry etching process such as a sputter etching process.

In an image forming part constituted like this, applying a pulse voltage of an average potential Vs to the electrodes 11 of the toner carrier 1 causes the toner T to fly to and form a cloud on the toner carrier 1, and the toner T is conveyed by conveyance resulting from either the rotation of the toner carrier 1 or a traveling wave field. In the meantime, an imaging bias voltage Vp is applied to the back electrode 31 on recording medium means 3 side.

In this state, a voltage Vg is applied to a common electrode 43 of toner controlling means 4, the ON voltage Vc-on shown in FIG. 4 is applied to a control electrode 42 when setting the state (ON state) in which the toner T is able to pass through the toner passage hole 41, and the OFF voltage Vc-off shown in FIG. 4 is applied to a control electrode 42 when setting the state (OFF state) in which the toner T is not able to pass through the toner passage hole 41.

In this case, by setting the voltage to these respective electrodes 11, 31, 42, 43 as will be described further below, lines of electric force 10 are formed in a loop shape between recording medium means 3 and the common electrode 43 of toner controlling means 4, bypassing the control electrode 42 that controls the passage of the toner, when toner controlling means 4 is set to the state in which the toner T of the toner carrier 1 is able to pass toward recording medium means 3.

Consequently, the toner, which has formed a cloud on the toner carrier 1, rides on the field resulting from the lines of electric force 10, passes through the toner passage hole 41 of toner controlling means 4 and impacts on recording medium means 3. Therefore, a direct toner image can be formed on recording medium means 3 by controlling the ON/OFF (switching control) of the respective toner passage holes 41 of toner controlling means 4 in accordance with the image. Then, after the lines of electric force 10 are formed in a loop shape between recording medium means 3 and the common electrode 43 of toner controlling means 4, thereby bypassing the control electrode 42 that controls toner passage, the adherence of toner to the control electrode 42 and in the area around the toner passage hole 41 is reduced, and clouding the toner enhances toner utilization efficiency.

Figure 7A:
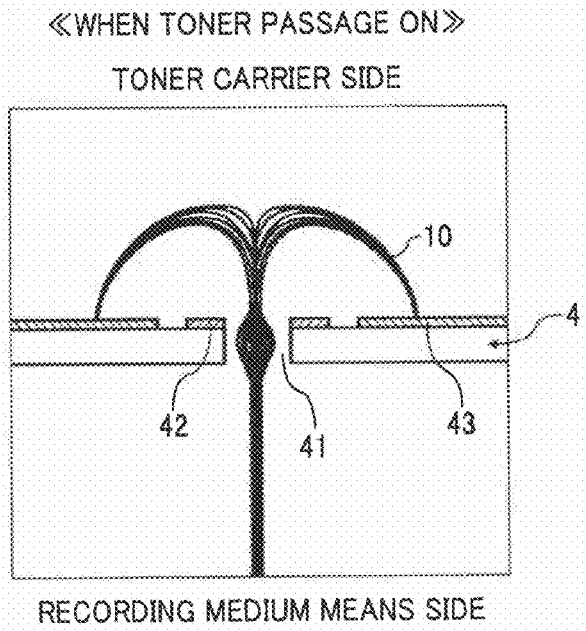
FIG. 7A is a diagram showing lines of electric force passing through a toner passage hole when toner control means is in the toner passage-enabled state, based on the results of a two-dimensional cross-sectional field strength distribution simulation.
Figure 7B:
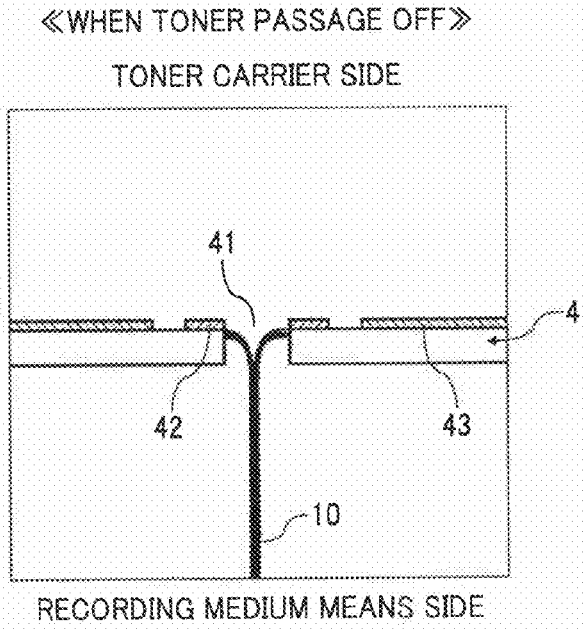
FIG. 7B is a diagram showing lines of electrical force passing through a toner passage hole when toner control means is in the toner passage-disabled state, based on the results of a two-dimensional cross-sectional field strength distribution simulation.

Next, the pulse voltage average potential Vs for the electrodes 11 of the toner carrier 1, the bias voltage Vp of the recording medium means 3 side, the control pulse voltage Vc for the control electrode 42 of toner controlling means 4, and the voltage Vg for the common electrode 43 will be explained by referring to FIGS. 7*a* and 7B. Furthermore, FIGS. 7A and 7B show lines of electric force passing through the toner passage hole based on the results of a two-dimensional cross-sectional field strength distribution simulation for the toner carrier 1, toner controlling means 4 and recording medium means 3.

A pulse voltage of an average potential Vs (the electric potential of temporally fluctuating electric potentials) is applied to the electrodes 11 of the toner carrier 1. In this case, the peak-to-peak value of the bias voltage is set in accordance with the electrode pitch and toner to be used. For example, it is preferable to set this value within the range of ±60 to ±300 Vpp (pp signifies peak-to-peak), and here a voltage of ±150 Vpp with a DC voltage component of 0V is applied. Therefore, the DC bias of the toner carrier 1 side relative to toner controlling means 4 is 0V, and the average potential Vs=0V. Furthermore, it is supposed that the spacing d of the toner carrier 1 and toner controlling means 4 is 0.3 mm.

Further, in this example, the diameter of the toner passage hole 41 of toner controlling means 4 is ϕ100 μm, the width of the ring-shaped control electrode 42 across the center of the hole is 30 μm, and the control electrode 42 is spaced 50 μm from the common electrode 43.

The bias voltage Vg to the common electrode 43 of toner controlling means 4 is −125V DC, and since the relationship with the average potential Vs pulse voltage to the toner carrier 1 is such that the toner T is constantly biased toward the toner carrier 1, no toner adheres to the surface of this common electrode 43.

Then, when setting the control electrode 42 of toner controlling means 4 to the state in which the toner T is able to pass through the toner passage hole 41 (ON state), the control pulse voltage Vc-on is +50V, and in the case of a blocking state at times other than when the toner T is allowed to pass through the toner passage hole 41 (when set to the passage-disabled state), the voltage Vc-off is −125V. The bias voltage Vp to the back electrode 31 of recording medium means 3 also depends on the spacing between toner controlling means 4 and recording medium means 3, but for example, between +200V and +1500V of DC voltage can be applied. Here, the spacing between toner controlling means 4 and recording medium means 3 is 0.3 mm and +300V DC is applied, resulting in a potential gradient that draws the negatively charged toner to the surface of recording medium means 3.

When creating a state in which the negatively charged toner is able to pass through the toner passage hole 41, setting the relationships of the electric potentials applied to the respective electrodes 11, 42, 43, 31 as above results in most of the lines of electric force that emanate from the electrode 31 of recording medium means 3 side, which has the highest electric potential on the plus side, and which pass through the toner passage hole 41 of toner controlling means 4, entering the lowest electric potential common electrode 43 after passing through the toner passage hole 41. Since there is 175V of electric potential in the control electrode 42 and the common electrode 43 of toner controlling means 4, which are close together at this time, strong lines of electric force are generated between these electrodes 42, 43 as well.

For this reason, as shown in FIG. 7A, when it is the state (ON state) in which the toner T is able to pass through the toner passage hole 41, the lines of electric force 10 that first pass through the toner passage hole 41 from the electrode 31 of recording medium means 3 side transition to a shape that fans out into a loop so that most of these lines of electric force 10 will enter the common electrode 43, which has the lowest electric potential at −125V, without entering the control electrode 42 (bypassing the control electrode 42). That is, the lines of electric force 10 are formed into a loop between recording medium means 3 side and the common electrode 43 of toner controlling means 4 and bypass the control electrode 42.

Therefore, a negatively charged toner T cloud on the toner carrier 1 can pass through the toner passage hole 41 along these lines of electric force 10, and most of the toner T can move to the surface of recording medium means 3.

A voltage of +50V is applied to the control electrode 42 at this time, and since the relationship with the 0V of the toner carrier 1 is one in which the toner T is adsorbed to the control electrode 42, rightfully you would expect the toner T to adhere to the surface of the control electrode 42 while this +50V is being applied, but as is clear from the results of the simulation shown in FIG. 7A, since the lines of electric force 10, which are passing through the toner passage hole 41 from the electrode 31 of recording medium means 3 side, are hovering over the control electrode 42 to which the +50V is being applied, the toner T is prevented from adhering to the control electrode 42.

Meanwhile, when in the blocking state (OFF state) in which toner T is not able to pass through the toner passage hole 41, −125V is applied to the control electrode 42 making the electric potential the same as that of the common electrode 43, and the relationship with the 0V electric potential of the toner carrier 1 is one in which the toner T is repulsed from the toner carrier 1 side, and since no toner T adheres to toner controlling means 4 and, as shown in FIG. 7B, there are no lines of electric force by which the electric force from the electrode 31 of the recording medium means 3 side can pass through the toner passage hole 41, the toner T does not pass through the toner passage hole 41 and a scummed image is not generated. Furthermore, the voltage applied to the control electrode 42 in the blocked state (OFF state) does not have to be the same electric potential as that of the common electrode 43, and a more minus potential can also block the passage of the toner T (create an OFF state).

Thus, this embodiment comprises a toner carrier, which causes the toner to fly, and which carries a toner cloud; recording medium means to which the toner adheres; and toner controlling means, which has a plurality of toner passage holes disposed between the toner carrier and recording medium means, and a control electrode for controlling toner passage is disposed on the toner carrier side surface of the toner controlling means in at least either one of the area surrounding the toner passage hole or the inner wall of the toner passage hole, a common electrode that is common to a plurality of toner passage holes is disposed on the external side of this control electrode, and when setting the state in which the toner of the toner carrier is able to pass through the toner passage hole of toner controlling means toward recording medium means, the formation of lines of electric force in a loop shape between the recording medium means side and the common electrode of toner controlling means that bypass the control electrode makes it possible to greatly reduce toner adherence to the surface of the control electrode to which an electric potential that attracts toner is being applied, and the area surrounding this control electrode, and enables the control of toner passage ON/OFF to be carried out stably, and, in addition, the lines of electric force that form between the bias potential of recording medium means side and the common electrode on the external side of the control electrode expand on the toner carrier side, becoming larger than the diameter of the toner passage hole, making it possible to capture a wide range of toner cloud and make it fly toward the imaging surface side, thereby raising toner utilization efficiency, assuring printing density, and enhancing printing speed.

Further, as the relationship of the electric potentials applied to the respective electrodes, when −50V is applied as the DC bias of the electrodes 11 of the toner carrier 1, and ±150 Vpp at −50 VDC is applied as the pulse peak-to-peak value of between +150V and −150V, the average potential Vs becomes −50V. Then, even if the electric potential Vc-on of the control electrode 42 of toner controlling means 4 is 0V when toner passage is ON and the electric potential Vc-off is −175V when toner passage is OFF, it is equivalent to the example described hereinabove. In this case, since the voltage Vc applied to the control electrode 42 is an ON or OFF minus polarity voltage of between 0 and −175V, the constitution of the driver circuit is simplified, resulting in a cost advantage.

Thus, setting the relationship of the electric potentials applied to the respective electrodes as follows when toner passage is ON as described hereinabove makes it possible to form lines of electric force in a loop shape between the recording medium means side and the common electrode of toner controlling means, bypassing the control electrode.

That is, when the electric potential of a temporally fluctuating average potential Vs is applied to the electrodes 11 of the toner carrier 1, voltage Vc-on is applied to the control electrode 42 of toner controlling means 4 when setting the state in which the toner is able to pass through the toner passage hole 41, and voltage Vc-off is applied to the control electrode 42 of toner controlling means 4 when setting the state in which the toner is not able to pass through the toner passage hole 41, voltage Vg is applied to the common electrode 43, and a bias voltage Vp is applied to the recording medium means 3 side to guide the toner that passed through the toner passage hole 41 to recording medium means 3 and make the toner adhere to recording medium means, the relationship of the respective electric potentials when setting the state in which the toner is able to pass through the toner passage hole 41 is Vp>Vc-on>Vs>Vg, and when the toner is negatively charged toner, the relationship is one in which the bias voltage Vp becomes higher on the plus potential side, and when the toner is positively charged toner, the setting is such that the bias voltage Vp becomes higher on the minus potential side.

Further, in this case, the relationship of the respective electric potentials when setting a state in which the toner is not able to pass through the toner passage hole 41 is Vs>Vg, and, in addition, Vs>Vc-off, and when the toner is negatively charged toner, it is preferable that the relationship be such that the average potential Vs becomes higher on the plus potential side, and when the toner is positively charged toner, it is preferable that the average potential Vs becomes higher on the minus potential side.

Setting the relationship of the electric potentials for the respective electrodes 11, 42, 43, 31 to the above-described relationships makes it possible to form an electric force between the bias potential on the recording medium means side and the common electrode on the external side of the control electrode, and this consequently makes it possible to greatly reduce the adherence of toner to the control electrode to which a toner attracting potential is applied, thereby stabilizing the control potential. Further, since the lines of electric force formed between the bias potential on the recording medium means side and the common electrode on the external side of the control electrode fan out to become larger than the diameter of the toner passage hole on the toner supplying side, it becomes possible to capture a wide range of toner cloud and make it fly toward the imaging surface side, thereby enabling the improvement of toner utilization efficiency, the assurance of printing density, and the enhancement of printing speed. Furthermore, since the common electrode of toner controlling means is in an electric potential relationship that constantly repulses the toner, toner adherence does not occur, making it possible to keep the common electrode potential constant, enabling the realization of a highly reliable image forming apparatus.

Furthermore, when there is a large amount of toner on the toner carrier 1 for high-speed printing, or when printing is to be carried out using a toner with a large electrification charge, the toner potential resulting from the toner charge cannot be ignored and must be taken into consideration in determining the electric potential to be applied to the respective electrodes.

Figure 8:
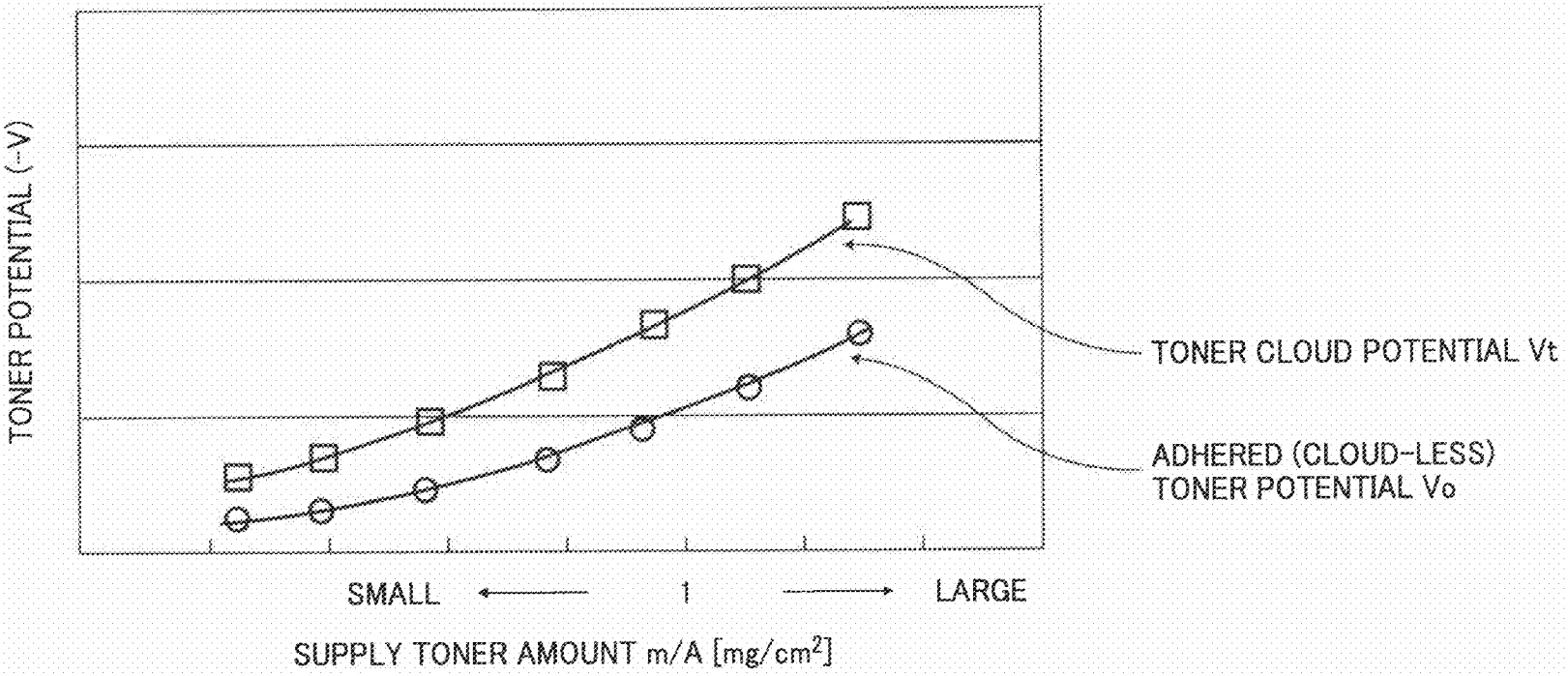
FIG. 8 is a graph showing an example of the relationship between the amount of supply toner and toner potential.

More specifically, FIG. 8 shows the changes in toner potential relative to the amount of supply toner m/A (mg/cm$^2$) on the surface of the toner carrier 1. The toner here is an example of a negatively charged toner, and, in accordance with increasing the amount of toner per unit area of the surface of the toner carrier 1, the surface potential as viewed from the control electrode 42 side rises on the minus potential side. Then, the electric potential Vt of the toner cloud, which is achieved by applying a voltage to the electrodes on the surface of the toner carrier 1, and causing the toner to repeatedly fly up and down along the mutual lines of electric force of the electrodes 11, rises greatly relative to the electric potential Vo of the supplied toner simply adhering as-is to the surface of the toner carrier 1. This is because the combined electrostatic capacity of the toner cloud that is in the space over the surface of the toner carrier 1 is smaller than the capacities around individual toner particles, and the electric potential rises as a result.

The measurement of this toner cloud potential Vt can be carried out easily by making the supplied toner into a cloud and setting the surface potentiometer upwardly thereof while applying a pulse voltage to the respective electrodes 11 on the surface of the toner carrier 1. More specifically, measurement is carried out by conveying the toner by rotating the toner carrier 1 or using a travelling wave pulse while applying a pulse that causes clouding and supplying toner from a one-component or two-component roller, which will be described further below, and installing the surface potentiometer about 2 mm above the surface of the toner carrier 1 in the location where toner controlling means 4 is located. The results shown in FIG. 8 is an example of a case of Vo when toner having an electrification charge of from −15 to −25 μC/g is supplied, and of toner potential Vt when this toner is flying at heights up to 200 μm from the proximity of the surface and is in a cloud state.

Figure 9:
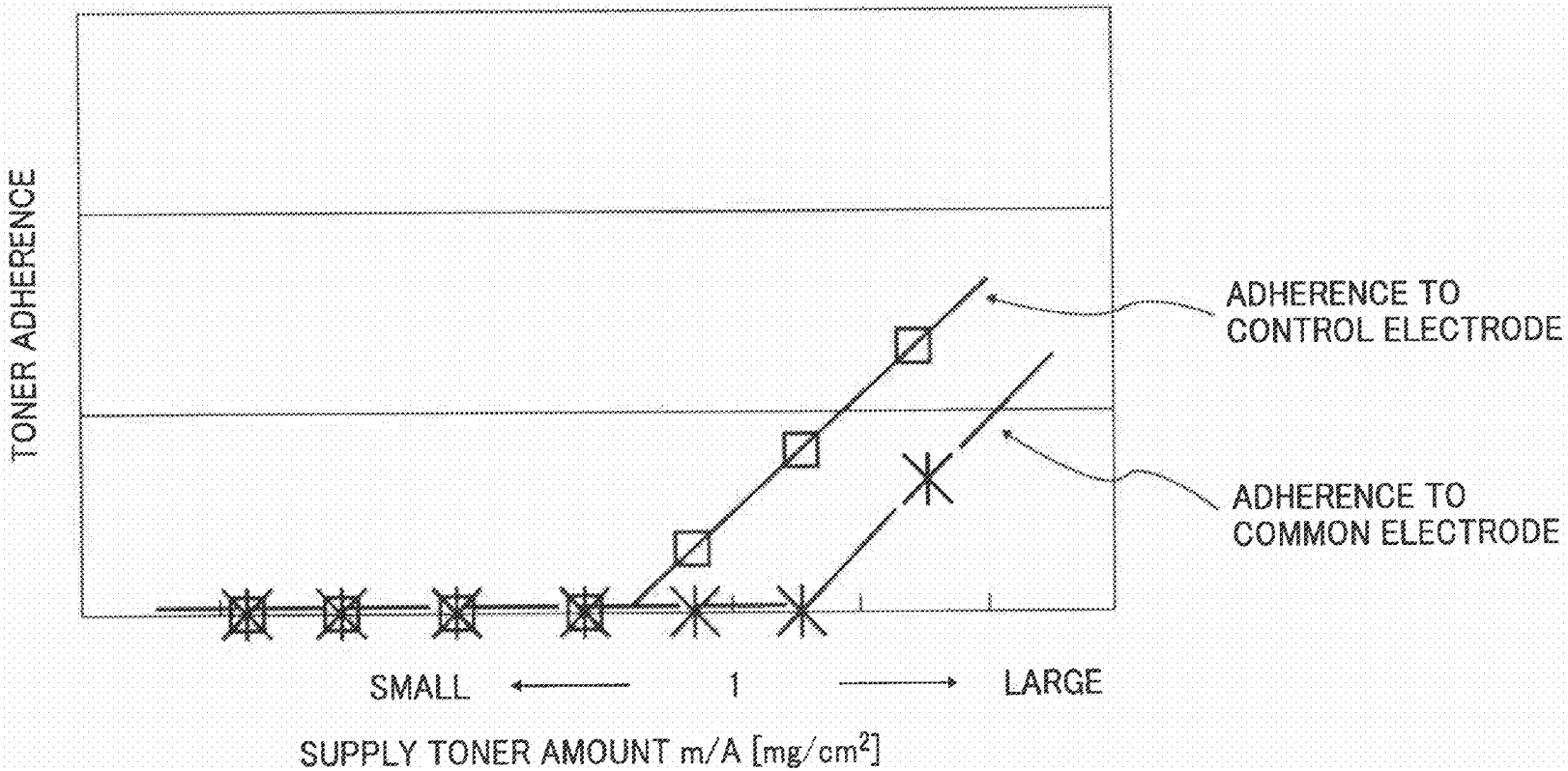
FIG. 9 is a diagram illustrating the relationship between the amount of supply toner and the adherence of toner to toner control means.

FIG. 9 shows the results of evaluations of the amounts of toner that adhered to the surfaces of the electrodes 42, 43 of toner controlling means 4, resulting from printing by carrying out toner passage ON/OFF control using toner controlling means 4 with respective amounts of supply toner shown in this FIG. 8. In the results shown in FIG. 9, there is no toner adherence to the electrodes 42, 43 in regions where the amount of supply toner is small, but when the amount of supply toner is increased to 0.9 mg/cm$^2$, the toner potential Vt becomes −80V and the toner begins to adhere to the control electrode 42.

This is because the electric potential of the toner carrier 1 rises on the minus side, and, equivalently, the electric potential difference with the common electrode 43 of toner controlling means 4 becomes smaller, as a result of which, of the lines of electric force that emanate from the recording medium means 3 side electrode and pass through the toner passage hole 41, the lines of electric force that directly enter the toner carrier 1 increase, and the loop-shaped lines of electric force that enter the common electrode 43 decrease. That is, this is due to the fact that when the loop-shaped lines of electric force diminish, the high flight energy toner does not ride on the loop-shaped lines of electric force and fly in the direction of the imaging surface, but rather flies up to the control electrode 42 to which ON voltage is being applied.

Furthermore, when the amount of supply toner increases in excess of 1.2 mg/cm$^2$, the toner potential Vt transitions to a value of −120V or more. In this region, the electric potential difference with the bias potential Vg (−125V) of the toner controlling means 4 common electrode 43 disappears, with the result that the toner, which has flight energy, begins to reach the common electrode 43 and toner adherence occurs. Further, the amount of toner adhering to the control electrode 42 also increases.

These toner adherences raise the frequency of regular electrode cleanings, and although the image forming apparatus can still be used, quality deteriorates. If conditions are such that toner adherence does not occur, there is no drop in image density even with continuous printing, making a highly reliable image forming apparatus a possibility.

Accordingly, when there is a large amount of toner, or when using a toner with a high electrification charge to form an image, setting the electric potentials for the respective electrodes using the following conditions will make it possible to avoid toner adherence to the electrodes, enhance toner utilization efficiency, and achieve high-speed printing without a drop in image density.

That is, when the charged toner flies from the toner carrier 1, and the toner potential as viewed from the control electrode 42 where the toner cloud exists is Vt, set the relationship of the respective electric potentials when toner passage is turned ON to Vp>Vc-on>(Vs+Vt)>Vg, and for negatively charged toner, the relationship is such that Vp becomes higher on the plus potential side, and for positively charged toner, the setting is such that Vp becomes higher on the minus potential side.

Further, when the relationships of the respective electric potentials when toner passage is turned OFF are (Vs+Vt) >Vg, and, in addition, (Vs+Vt)>Vc-off, for negatively charged toner, set the relationship such that (Vs+Vt) becomes higher on the plus potential side, and for positively charged toner, set the relationship such that the (Vs+Vt) becomes higher on the minus potential side.

Setting the electric potentials for the respective electrodes 11, 42, 43, 31 as described hereinabove, that is, properly setting the respective electrode potentials on the toner supply side by also taking into account the electric potential resulting from the toner of the toner carrier surface taking flight, the adherence of toner to the control electrode and so forth can be reduced, toner utilization efficiency can be enhanced, and a high density, high-speed printing image forming apparatus can be realized even when the printing speed is fast and there is a large amount of supply toner, or when the toner has a high electrification charge. In this case, even in a state in which toner clouding has not been carried out (a pulse has not been applied), setting the above-described electric potential relationships will enhance reliability due to the fact that toner does not adhere to the control electrode and the like.

Further, as described hereinabove, the constitution is such that the toner carrier has a plurality of electrodes disposed at prescribed intervals on the surface side, voltages of a relationship that repeatedly causes the toner to fly between the mutually adjacent electrodes alternately in the toner attraction direction and repulsion direction are applied, and the distance d between the toner carrier surface and the surface of the toner carrier side of toner controlling means is larger than the two-phase inter-electrode pitch p applied to the electrodes (or an n-phase inter-electrode pitch when applying an n-phase voltage to the respective electrodes every n electrodes).

Consequently, this makes the loop-shaped lines of electric force formed from the imaging bias of the recording medium means side to the common electrode of toner controlling means strong, enabling more of the toner cloud to fly toward the imaging surface and making it possible to form high quality dots at high-speed.

Furthermore, in the above examples, the conditions when a clouding pulse is applied to a plurality of electrodes on the surface of the toner carrier to form a toner cloud were explained, but by setting the same conditions as described above when making the toner-based potential, as viewed from the control electrode side in a state in which the toner is not allowed to fly, the Vt, the result is that the adherence of toner to the electrodes is avoided. That is, even in a state in which the clouding pulse application is OFF and there is no toner cloud, a slight amount of toner is floating around. The electric potential of this slight amount of floating toner can be ignored, but the toner that lands and stays on the surface of the toner carrier has electric potential, and the same effect can be achieved by setting (Vs+Vt), which takes this electric potential Vt into account, to the same range of conditions as mentioned hereinabove.

As described above, here the toner on the surface of the toner carrier is made to fly, and temporally fluctuating electric potentials are applied to clouding means. For example, the supply of toner is supplied from the toner carrier, which has a plurality of electrodes that are disposed on the surface of the toner carrier for conveying and supplying the toner at a prescribed pitch in the direction that is orthogonal to the toner conveying direction. When there is no common electrode of toner controlling means here, or the setting of the electric potentials for the respective electrodes is not in the above-described range, toner quickly adheres to the electrodes, making it impossible to avoid a drop in reliability. Further, since toner cloud utilization efficiency drops drastically, it is not possible to achieve an image forming apparatus that prints at high-speed and assures image density.

Next, a second example of the constitution of the image forming part 102 that constitutes an image forming apparatus related to the present invention will be explained by referring to FIG. 10.

In this image forming part, a plurality of toner passage holes (openings) 41 that enable the toner T to pass through are disposed in toner controlling means 4 as described hereinabove, a ring-shaped control electrode 42 is individually provided for each toner passage hole 41 in the areas around the respective toner passage holes 41 of the surface of this toner supply side of toner controlling means 4 (the surface of the toner carrier 1 side), and a common electrode 43 that is common to a plurality of toner passage holes 41 is disposed by way of an insulating region on the external side of the control electrode 42 relative to the toner passage hole 41.

Furthermore, a discrete back electrode 44 having a larger surface area than the control electrode 42 is individually provided for each toner passage hole 41 in the areas around the respective toner passage holes 41 of the surface of toner controlling means 4 on the recording medium means 3 side (surface on the recording medium means 3 side), and an electric potential Vs (=Vr) that is the same as that of a constant control electrode 42 is applied to this discrete back electrode 44.

Figure 11B:
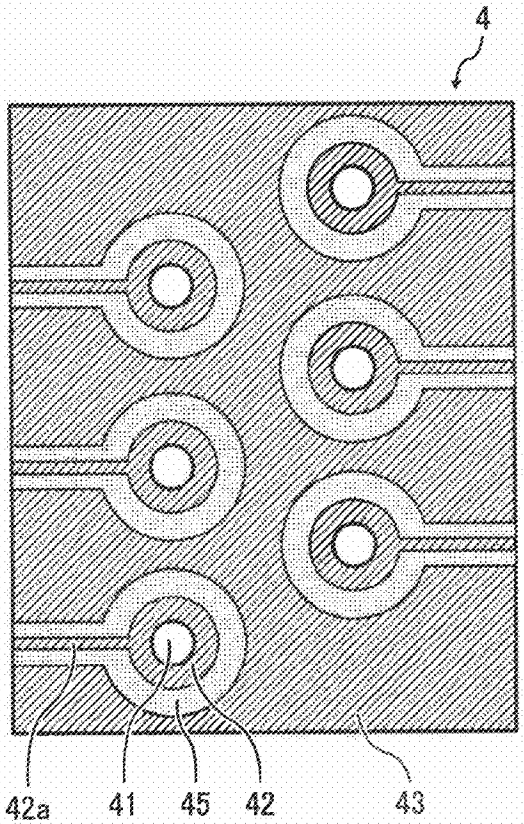
FIG. 11B is a diagram showing the toner supply side of the other example of toner control means of this image forming part.
Figure 11A:
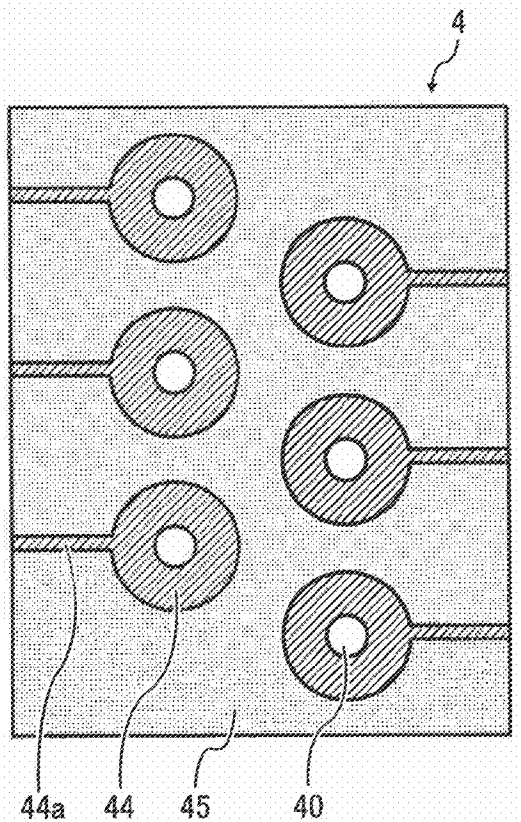
FIG. 11A is a diagram showing the imaging surface side of another example of toner control means of this image forming part.

One example of the specific constitution of toner controlling means 4 like this will be explained by referring to FIGS. 11A and 11B.

Toner controlling means 4 has a constitution, which disposes a 10 μm- to 100 μm-wide ring-shaped control electrode 42 so as to surround a toner passage hole 41 on the surface of the toner supplying side (toner carrier 1 side) of an insulating board (base material) 45 the same as was described using FIGS. 6A and 6B, and which disposes a common electrode 43 that applies a common bias voltage Vg to a plurality of toner passage holes 41, in a solid shape so as to cover the entire open space, leaving a space for an insulating region of 20 μm to 50 μm from this control electrode 42.

Meanwhile, a ring-shaped discrete back electrode 44 having a diameter that is larger than the control electrode 42 is disposed in a shape that surrounds a toner passage hole 41 on the recording medium means side (image surface side) of the insulating board 45. This discrete back electrode 44, for example, is formed using Al vapor deposition.

Furthermore, since the constitutions of the toner carrier 1, recording medium means 3 and other such components are the same as the basic constitution, explanations thereof will be omitted.

Figure 12:
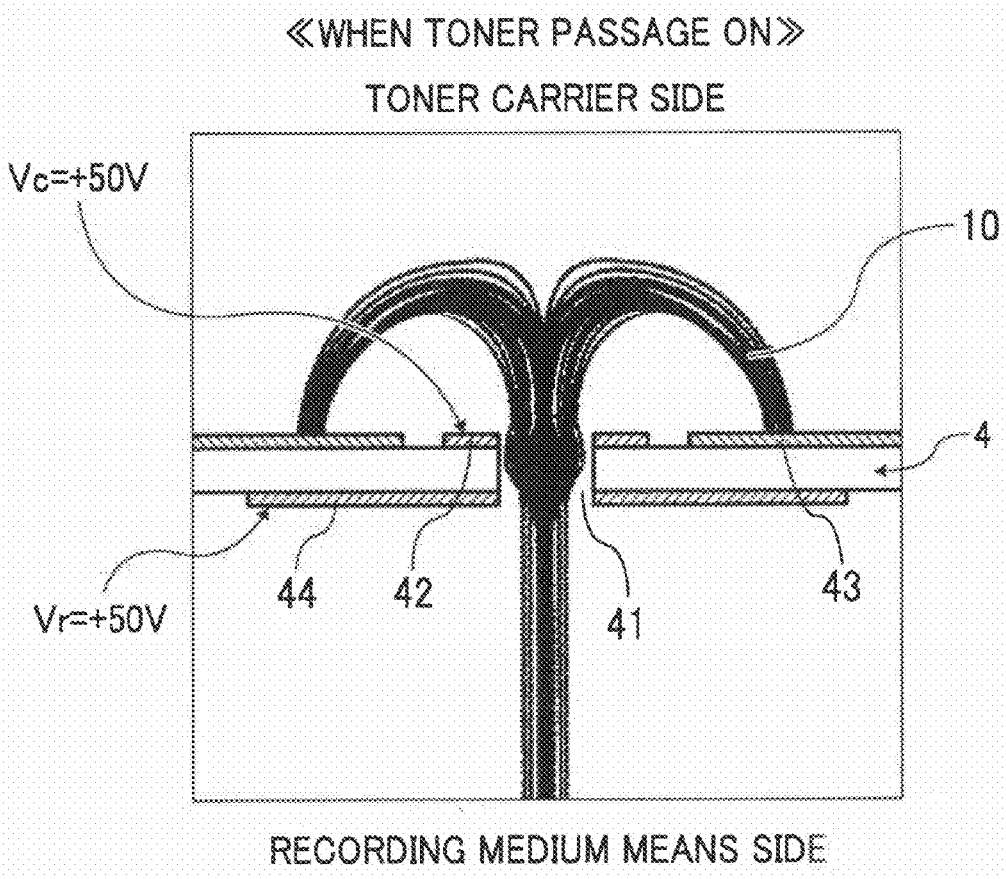
FIG. 12 is a diagram showing lines of electric force passing through a toner passage hole when toner control means is in the toner passage-enabled state, based on the results of a two-dimensional cross-sectional field strength distribution simulation.

For toner controlling means 4 constituted like this, FIG. 12 shows simulation results for electrode field distribution when +50V, −125V and +50V are respectively applied to the respective control electrodes 42 as electric potential Vc, to the common electrode 43 as electric potential Vg, and to the discrete back electrode 44 as electric potential Vr.

The electric potential Vr of the discrete back electrode 44 and the electric potential Vc of the control electrode 42 are the same here, and the average potential Vs for the electrodes 11 of the toner carrier 1 is 0V.

It is clear from the results that the loop-shaped electric field (lines of electric force 10), which captures the toner cloud and causes this toner cloud to fly to the imaging surface side when in a state (ON state) in which the toner is able to pass through the toner passage hole 41, is wider and has more lines of electric force 10 passing through the toner passage hole 41 than in the case of the above-described FIG. 7A (when there is no discrete back electrode 44).

This is the result of that fact that, whereas the electric field of the voltage Vg of the common electrode 43 acts on the imaging surface side, and also affects the vicinity of the toner passage hole 41 of the imaging surface side, thereby limiting the passage of lines of electric force from the imaging bias Vp in the case shown in FIG. 7A, in the example of FIG. 12, the voltage Vr of the discrete back electrode 44 is the same electric potential as that of voltage Vc, and more numerous lines of electric force pass through the toner passage hole 41 due to the surface potential in the proximity of the toner passage hole 41 on the imaging surface side of the control electrode being a higher electric potential than in the case of FIG. 7A.

Setting the surface area of the discrete back electrode 44 to a shape that is larger than the surface area of the respective control electrodes 42 of toner controlling means 4 at this time makes the above-mentioned effects more remarkable. Also, making the shape of the respective control electrodes 42 and respective discrete back electrodes 44 of toner controlling means 4 a ring shape so as to surround the toner passage hole 41 and setting the outer diameter dimensions of the discrete back electrode 44 larger than the outer diameter of the control electrode 42 also makes the above-mentioned effects more remarkable.

A case in which the electric potential Vr of the discrete back electrode 44 and the electric potential Vc of the control electrode 42 of toner controlling means 4 differ will be explained here by referring to FIGS. 13A and 13B and FIGS. 14A and 14B.

Figure 10:
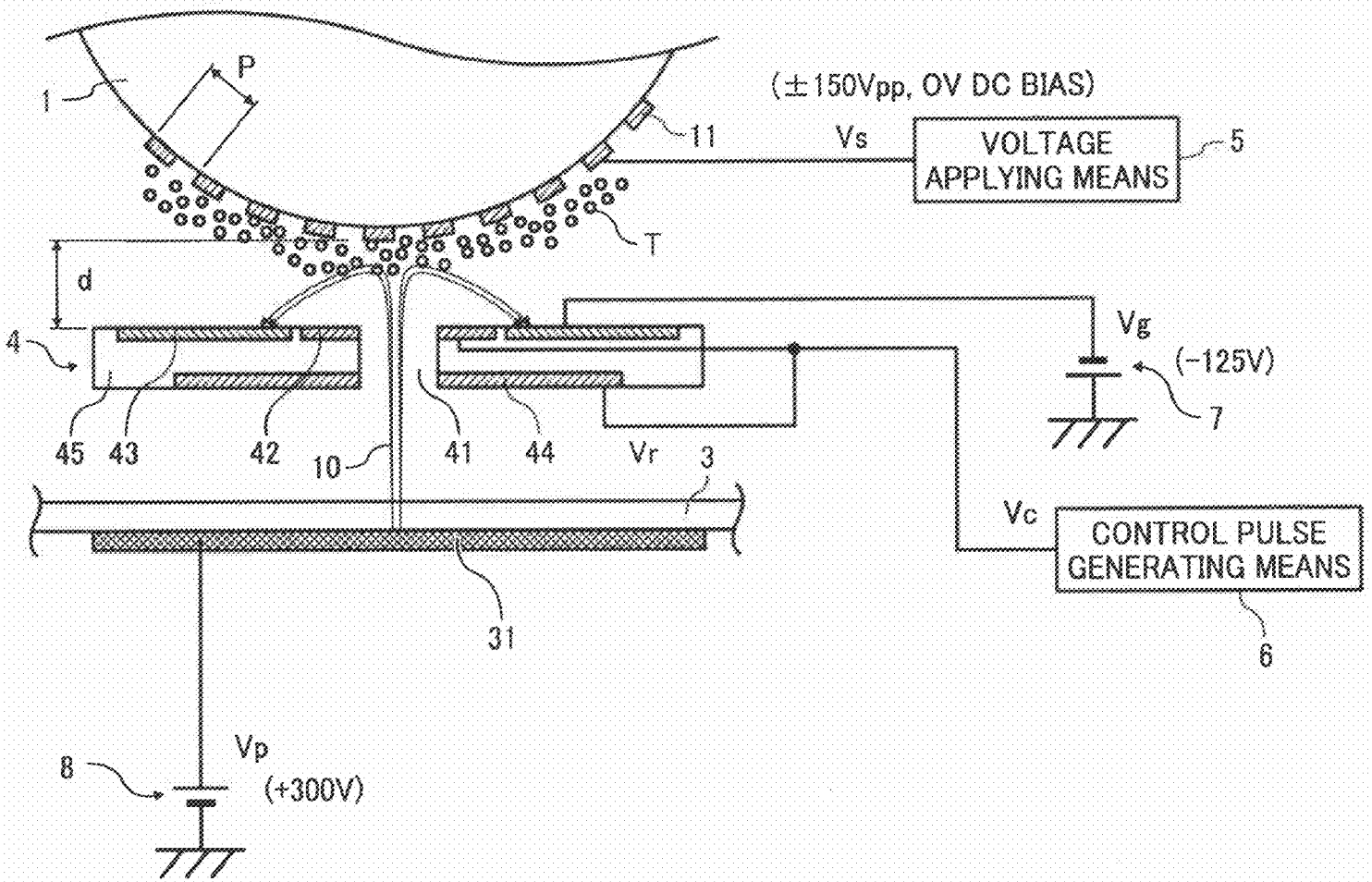
FIG. 10 is a diagram showing the constitution of a second example of the image forming part.
Figure 13A:
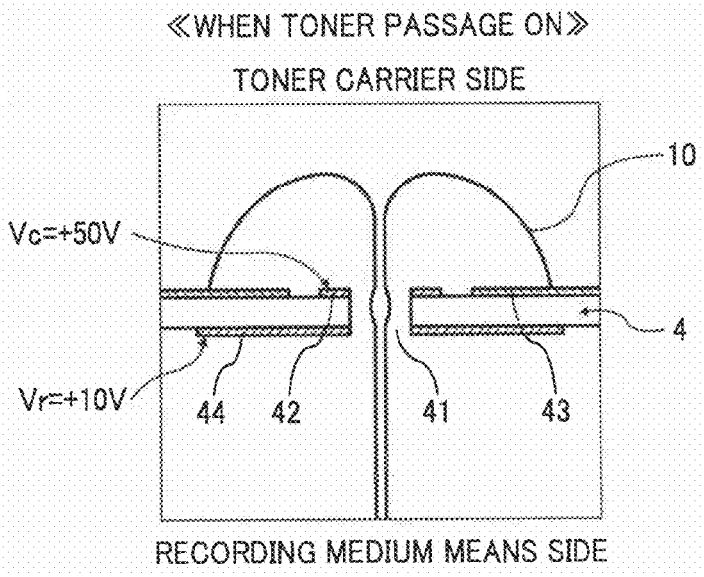
FIGS. 13A and 13B show the field distributions when the voltage applied to a discrete back electrode is lowered relative to the electric potential applied to the control electrode in the constitution of FIG. 10.
Figure 13B:
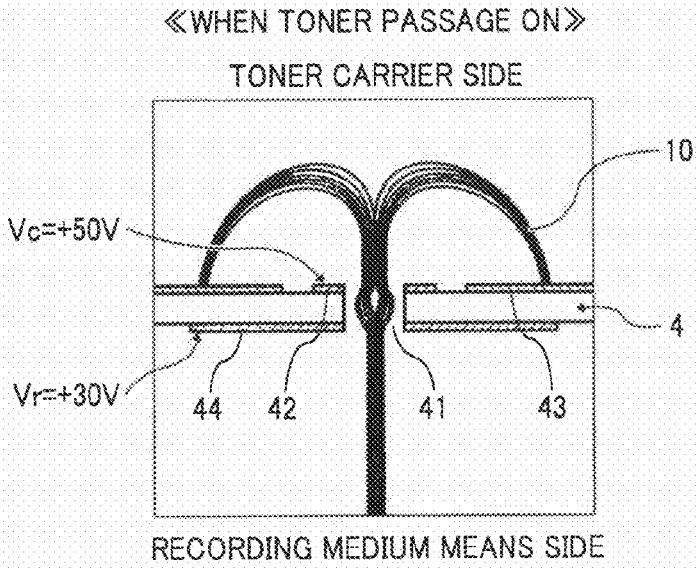
Figure 14A:
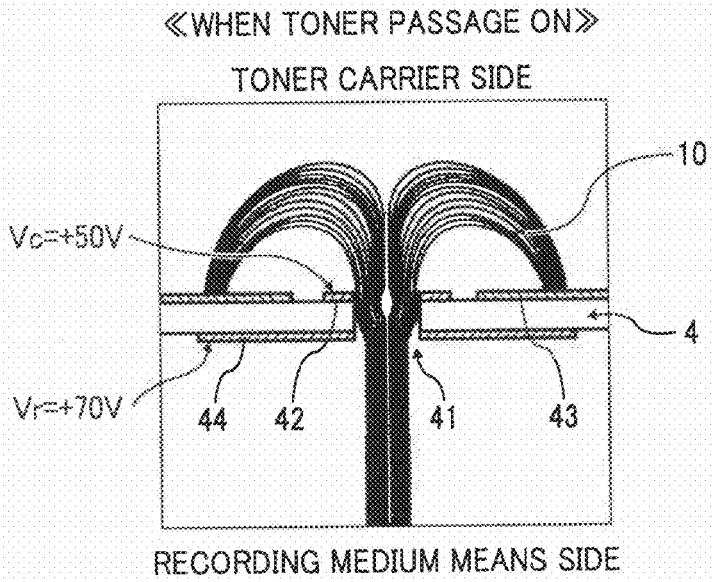
FIGS. 14A and 14B show the field distributions when the voltage applied to the discrete back electrode is raised relative to the electric potential applied to the control electrode in the constitution of FIG. 10.
Figure 14B:
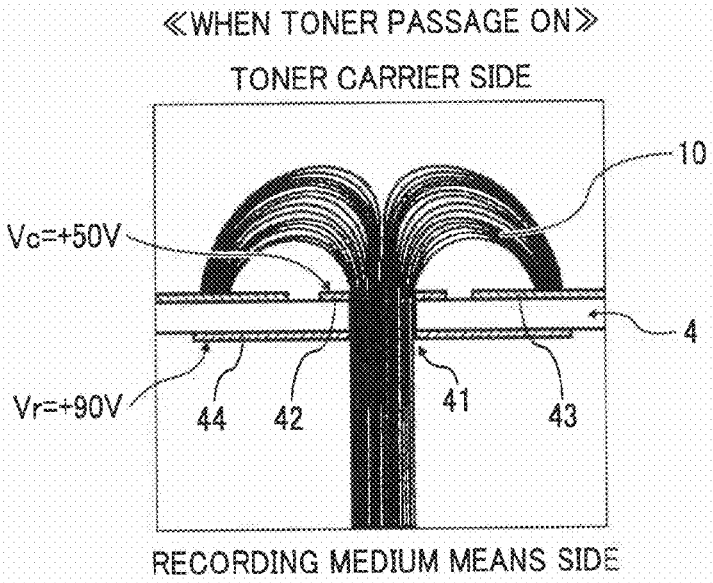

FIGS. 13A and 13B show the field distribution when the voltage Vr applied to the discrete back electrode 44 is lowered to +10V and +30V (becoming −40V and −20V lower) relative to the electric potential Vc (+50V) applied to the control electrode 42 in the constitution of FIG. 10. Further, FIGS. 14A and 14B show the field distribution when the voltage Vr applied to the discrete back electrode 44 is raised to +70V and +90V (becoming +20V and +40V higher) relative to the electric potential Vc (+50V) applied to the control electrode 42 in the constitution of FIG. 10. Furthermore, the other voltages are the same as the example (embodiment) of FIG. 12.

Based on these results, in the case of FIGS. 13A and 13B, in which the voltage Vr of the discrete back electrode 44 is more of a minus side potential than the voltage Vc of the control electrode 42, the amount of lines of electric force 10 passing through the toner passage hole 41 from the recording medium means 3 side, to which the imaging surface bias voltage Vp is being applied, decreases, with the result that the force that causes the toner cloud to fly to the imaging surface (recording medium means 3) side decreases and the imaging density deteriorates. This is due to the fact that the lines of electric force passing through the toner passage hole 41 are reduced in order that the lines of electric force formed between the voltage Vr of the discrete back electrode 44 and the imaging surface bias voltage Vp can protrude from the opening edge part of the toner passage hole 41.

Further, in the case of FIGS. 14A and 14B, in which the voltage Vr of the discrete back electrode 44 is more plus side potential than the voltage Vc of the control electrode 42, the lines of electric force 10 passing through the toner passage hole 41 from the recording medium means 3 side, to which imaging surface bias voltage Vp is being applied, are spread out across the entire toner passage hole 41, and the diameter of the dot that is formed is larger than in the example of FIG. 12. Thus, it is necessary to reduce the diameter of the opening of the toner passage hole 41, and when toner, fine powder, paper particles and so forth adhere to the toner passage hole 41, the flying toner is apt to collide and generate dead pixels, reducing reliability compared to that of the example of FIG. 12.

Further, since a constitution, which applies the voltage Vc of the control electrode 42 and the voltage Vr of the discrete back electrode 44 at respectively different voltages for each dot, will require two-times the number of drivers (circuits) as there are toner passage holes 41, costs will go up.

Therefore, applying the same voltage as the control electrode 42 voltage Vc and the discrete back electrode 44 voltage Vr maintains the strength of the field that causes the toner to fly to the imaging surface, and, in addition, the diameter of a formed dot can be made smaller than the diameter of the opening of the toner passage hole 41 to produce a high-resolution image, and rising driver costs can also be curbed.

Then, the shapes of the control electrode 42 and discrete back electrode 44 for achieving greater effects, as was explained hereinabove, are set so that the surface area of the discrete back electrode 44 is larger than the surface area of the respective control electrodes 42 of toner controlling means 4. Or, the shapes of the respective control electrodes 42 and respective discrete back electrodes 44 of toner controlling means 4 are made practically ring shaped so as to surround a toner passage hole 41, and the outer diameter dimensions of the discrete back electrode 44 are set larger than the outer diameter of the control electrode 42.

Figure 15:
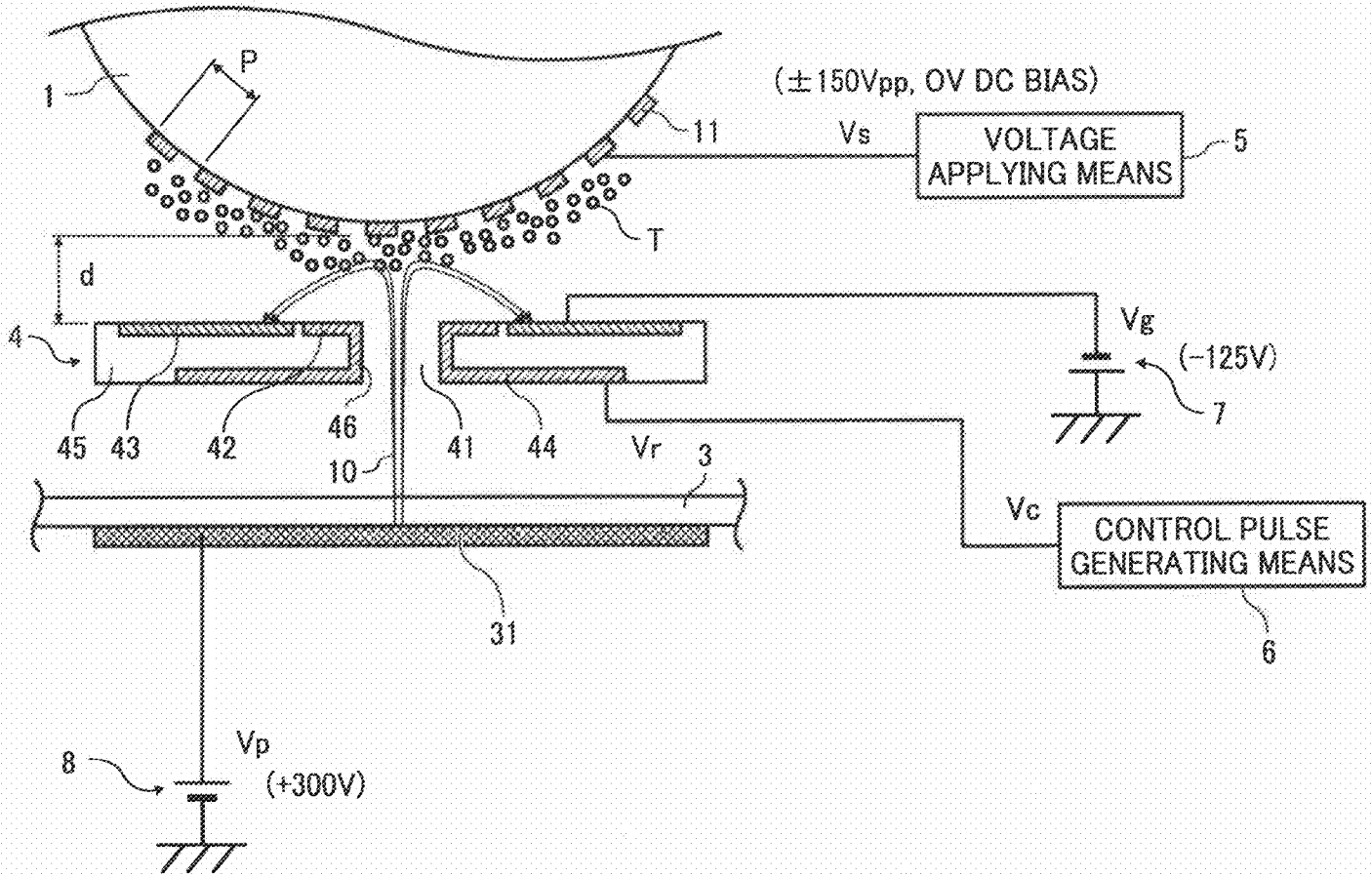
FIG. 15 is a diagram showing the constitution of a third example of the image forming part.

Next, a third example of the constitution of the image forming part 102 constituting the image forming apparatus related to the present invention will be explained by referring to the schematic diagram shown in FIG. 15.

In this image forming part, the control electrode 42 and discrete back electrode 44 of toner controlling means 4 are connected via a conducting pattern 46 disposed on the inner wall of the toner passage hole 41. The formation of this conducting pattern 46, for example, can be carried out by covering everything besides the toner passage hole 41 with a metal mask, depositing a conductive material, such as Al, Au, ITO or the like, and forming a film on the inner wall using sputtering, or, subsequent to forming a resist layer on the parts other than the toner passage hole 41, forming a conductive film via plating.

Consequently, the voltage Vc applied to the control electrode 42 and the voltage Vr applied to the discrete back electrode 44 of toner controlling means 4 are always the same voltage. In this case, connecting a lead pattern 44*a* of the discrete back electrode 44 to a driver not shown in the figure, and applying voltage Vc (=Vr) will do away with the need for the lead pattern 42*a* from the control electrode 42 shown in FIGS. 5A, 5B, 6A and 6B, which was explained using the first example described hereinabove, thereby further reducing the adherence of toner to the control electrode 42. Further, the number of drivers for generating control signals for forming toner dots using the respective toner passage holes 41 can correspond to the number of the respective toner passage holes 41.

Furthermore, the continuity of the control electrode 42 and the discrete back electrode 44 was achieved here by a conducting pattern 46 disposed on the inner wall of the toner passage hole 41, but the present invention is not limited to this, and it is also possible to provide a through hole (hole) for continuity in a place other than the toner passage hole 41 to achieve electrical continuity between the control electrode 42 and the discrete back electrode 44. Since the conducting through hole need only take into account conduction at this time, the minimum number of required holes will do, and because the conduction process can take up the entire inner wall of the through hole, conductive ink can be spray filled into the hole for conduction.

Covering the entire inner wall of the toner passage hole 41 with a conductive film (conducting pattern 46) means that the loop-shaped lines of electric force for causing the toner to fly will be greatly distorted by the inside of the toner passage hole 41, but using a constitution that disposes a hole for conduction in a place other than the toner passage hole 41 will hold the distortion of these lines of electric force in check, and for the flight of the toner, will reduce the curvature of the flight path to the imaging surface, thereby enhancing dot quality.

Figure 16:
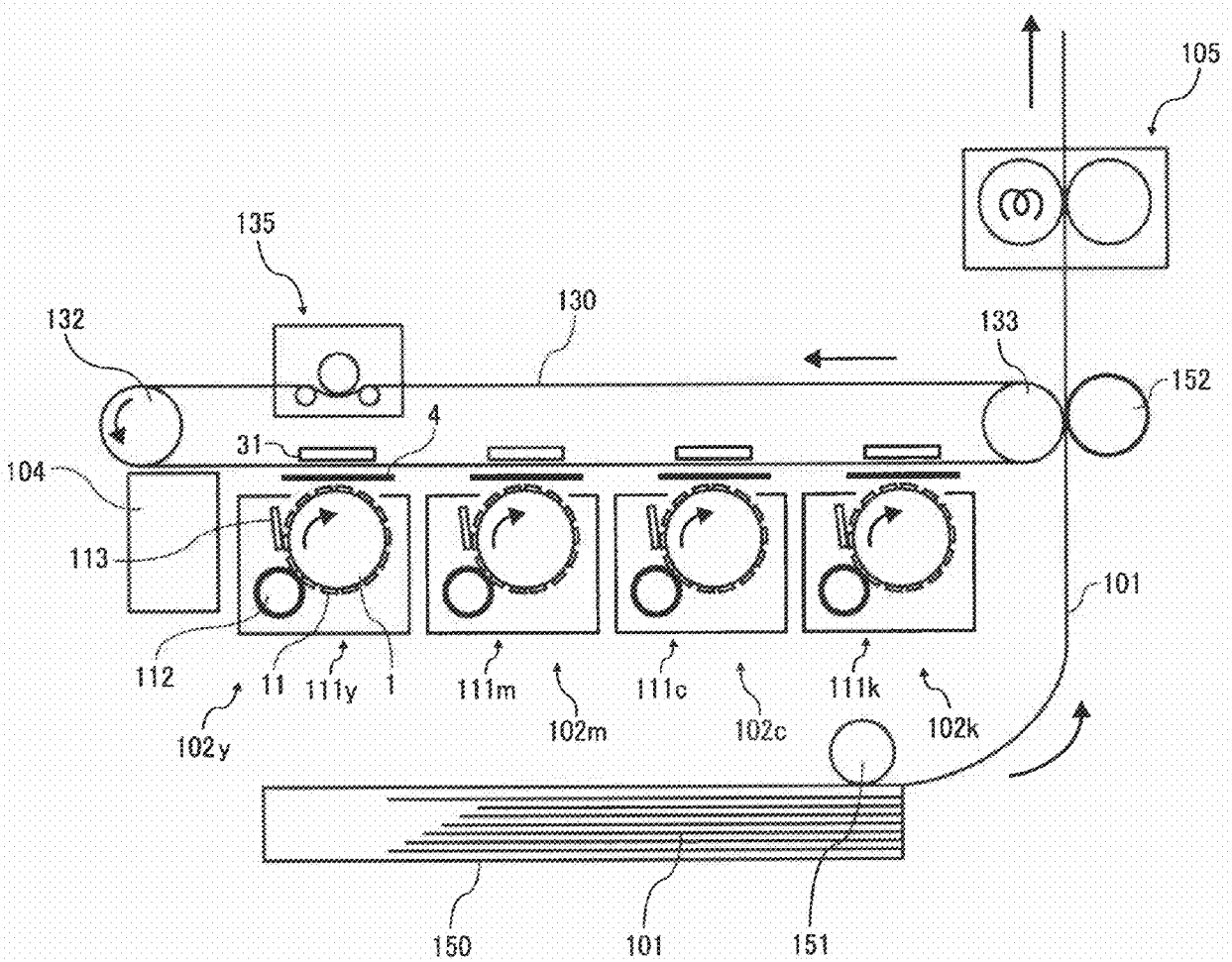
FIG. 16 is a diagram schematically showing the constitution of a second embodiment of the image forming apparatus related to the present invention.

Next, a second embodiment of the image forming apparatus related to the present invention will be explained by referring to FIG. 16. Furthermore, FIG. 16 schematically shows the constitution of this image forming apparatus.

This image forming apparatus is an example of an image forming apparatus that forms a color image by providing four (102*y*, 102*m*, 102*c*, 102*k*) of the image forming part 102 of the embodiment described hereinabove, clouding toner of the four colors yellow (Y), magenta (M), cyan (C) and black (K), and carrying out ON/OFF control using toner controlling means.

That is, this image forming apparatus disposes four toner supply units 111$y$, 111$m$, 111$c$, 111$k$ (Will be called the "toner supply unit 111" when not distinguishing between the colors. The same holds true hereinbelow) for supplying four colors of toner clouds—yellow (Y), magenta (M), cyan (C) and black (K)—along an intermediate transfer recording medium 130, which is recording medium means, and disposes any of the respective examples of toner controlling means 4 described hereinabove between the respective toner supply units 111 and the intermediate transfer recording medium 130.

The intermediate transfer recoding medium 130 here is suspended between two rollers 132, 133 and moves in a rotating fashion in the direction of the arrows. Back electrodes 31, which are the recording medium means side electrodes, are disposed corresponding to the respective toner supply units 111 in the reverse side (inner side) of this intermediate transfer recording medium 130. Further, a cleaning unit 135 for removing residual toner from the intermediate transfer recording medium 130 subsequent to transfer is also provided.

The toner supply unit 111 comprises a cylindrical-shaped toner carrier 1 on which a plurality of electrodes 11 for applying voltage for clouding toner are disposed one next to the other; a rotating toner supplying roller 112 that supplies the toner to this toner carrier 1; and a blade 113 for controlling the amount of toner on the toner carrier 1.

Here, in addition to the toner being supplied to the toner carrier 1 by the toner supplying roller 112, the frictional electrification of the toner is carried out by the friction generated between the toner on the toner supplying roller 112 and the toner carrier 1. Further, the blade 113 on the downstream side of the toner supplying roller 112 maintains the amount of toner on the surface of the toner carrier 1 at a thin layer, and also serves to stabilize the magnitude of the toner charge.

Furthermore, liquid applying means 104 for applying an application liquid comprising a softening agent that softens the toner by either dissolving or swelling the resin comprised in the toner is disposed on the surface of the intermediate transfer recording medium 130, which constitutes the imaging surface, even further upstream than the furthest upstream toner supply unit 111$y$ (image forming part 102$y$).

Then, the toner supplied by the toner supply unit 111 is flown to the intermediate transfer recording medium 130 by ON/OFF being controlled in accordance with the image by toner controlling means 4, and a color toner image is formed in the intermediate transfer recording medium 130.

At this time, applying the application liquid, which comprises a softening agent for softening the toner by either dissolving or swelling the resin comprised in the toner, to the surface of the intermediate transfer recording medium 130 using liquid applying means 104 prior to toner image formation, as was explained hereinabove, increases the adhesive force between the toner and the imaging surface when the toner collides with the imaging surface, and, at the same time reduces the repulsion force of the imaging surface when the toner collides, thereby lessening toner spatter, and furthermore, since the softening of the toner on the surface of the intermediate transfer recording medium 130 (imaging surface) is promoted by dissolving or swelling the resin comprised in the toner using the softening agent in the application liquid, heat fixing is carried out after a toner image has been transferred to the surface of the recording paper 101 by a transfer unit 152, but extremely less energy can be used for fixing at this time than in the past, and applying a sufficient amount of application liquid can eliminate the need for heat energy and make it possible to achieve fixing using only pressure.

In the meantime, a paper feeding unit 150 that accommodates recording paper 101 is disposed at the bottom, recording paper 101 is fed from the paper feeding unit 150 by a pickup roller (paper feeding roller) 151, a toner image on the intermediate transfer recording medium 130 is transferred to the recording paper 101 by the transfer unit 152, which is disposed facing the roller 132 around which the intermediate transfer recording medium 130 is suspended, the toner is melting and fixed onto the recording paper 101 by the fixing unit 105, and the recording paper 101 is ejected.

Furthermore, although not shown in the figure here, toner image transfer from the intermediate transfer recording medium 130 to the recording paper 101 is carried out by applying a + bias to the transfer roller 152 of the back side of the recording paper 101. Further, as mentioned above, residual toner left on the intermediate transfer recording medium 130 is cleaned off by the cleaning unit 135, and the next image is formed.

Thus, this image forming apparatus is an intermediate transfer recording system that forms a four-color image on an intermediate transfer recording medium, and thereafter transfers this image to a piece of recording paper supplied from a paper feeding unit. In the case of this intermediate transfer recording system, it is easy to assure the precision that maintains a constant interval between the imaging surface (also called the toner impacting surface and the image forming surface) and toner controlling means, and makes it possible to achieve high image quality under low toner flight speed conditions. Further, an image forming apparatus, which prevents the build up of charges by smoothly adjusting volume resistivity, achieves an electric potential fluctuation-free imaging surface, and carries out direct printing by turning ON/OFF the passage of a toner cloud, is highly sensitive to electric potential and is susceptible to fluctuations in quality in response to fluctuations in image surface bias potential, but this constitution can achieve high reliability, and can produce high-quality color images.

Figure 17:
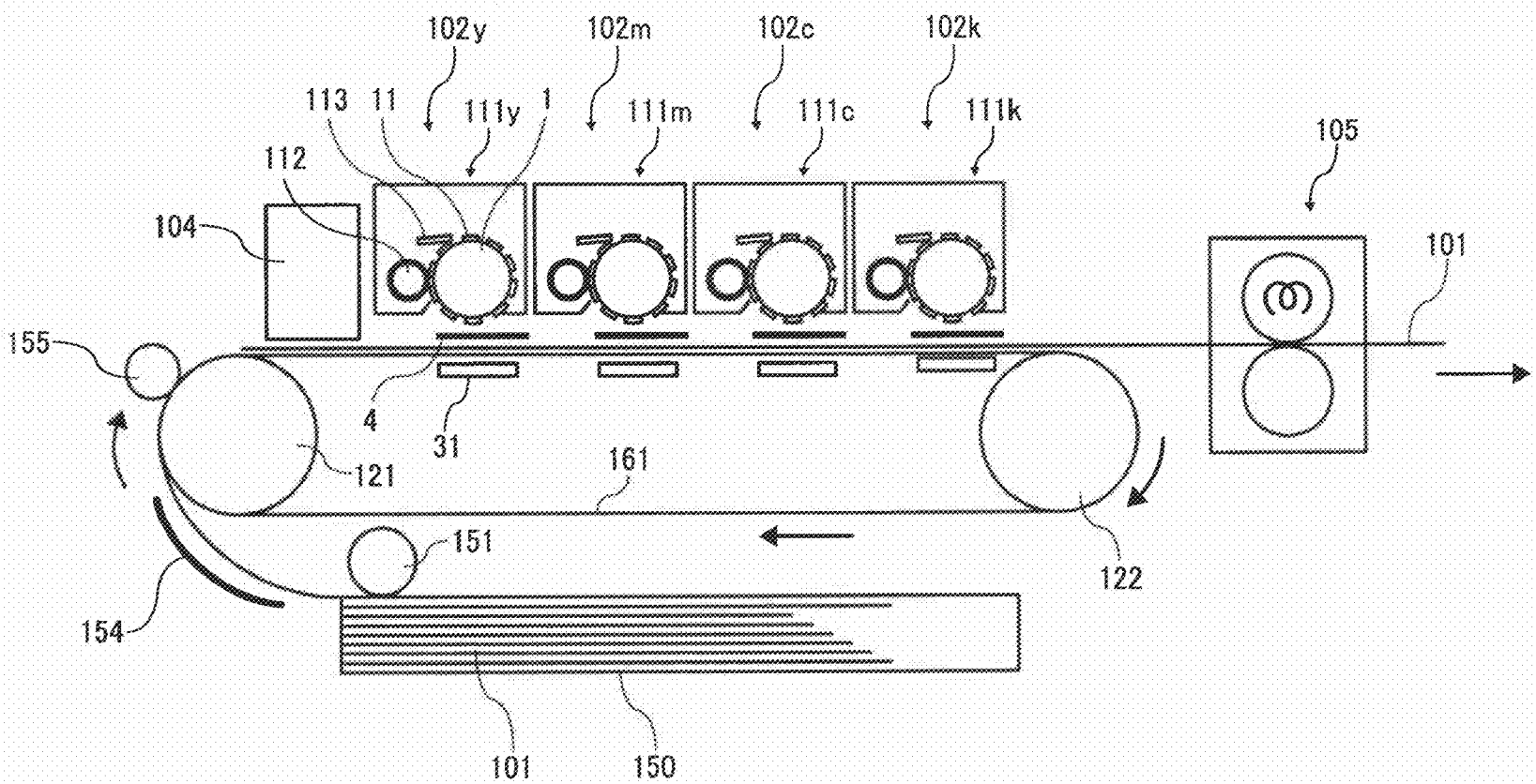
FIG. 17 is a diagram schematically showing the constitution of a third embodiment of the image forming apparatus related to the present invention.

Next, a third embodiment of the image forming apparatus related to the present invention will be explained by referring to FIG. 17. Furthermore, FIG. 17 schematically shows the constitution of this image forming apparatus.

This image forming apparatus is an example in which, as in the first embodiment, recording medium means is recording paper, and an image is formed directly on the recording paper. That is, recording paper 101 provided from the paper feeding unit 105 here is electrostatically clamped to a paper conveyer belt 161, passed through a region of toner supply units 111, and a color image is formed directly on the recording paper 101 by controlling the ON/OFF of toner controlling means 4 in accordance with the image.

Furthermore, the paper conveying belt 161 is formed from polyimide, suspended around two rollers 121, 122, moved in a rotating manner in the direction of the arrows, and electrostatically clamps, holds and conveys the recording paper 101 by being charged by a charging roller or other such charging means not shown in the figure. Furthermore, a guide 154 for guiding the recording paper 101 from the paper feeding unit 105 to the paper conveying belt 161, a resistance roller 155 and the like are also provided.

Furthermore, liquid applying means 104 for applying an application liquid comprising a softening agent that softens the toner by either dissolving or swelling the resin comprised in the toner is disposed on the surface (imaging surface) of the recording paper 101, which constitutes the imaging surface, even further upstream than the furthest upstream toner supply unit 111*y* (image forming part 102*y*).

Consequently, applying the application liquid, which comprises a softening agent for softening the toner by either dissolving or swelling the resin comprised in the toner, to the surface of the recording paper 101 using liquid applying means 104 prior to toner image formation, as was explained hereinabove, increases the adhesive force between the toner and the imaging surface when the toner collides with the imaging surface, and, at the same time reduces the repulsion force of the imaging surface when the toner collides, thereby lessening toner spatter, and furthermore, since the softening of the toner on the surface of the recording paper 101 (imaging surface) is promoted by dissolving or swelling the resin comprised in the toner using the softening agent in the application liquid, heat fixing is carried out after forming a toner image on the surface of the recording paper 101, but extremely less energy can be used for fixing at this time than in the past, and applying a sufficient amount of application liquid can eliminate the need for heat energy and make it possible to achieve fixing using pressure alone.

In this constitution, since there are a polyimide or other such paper conveying belt 161 and recording paper 101 between toner controlling means 4, which controls toner passage, and the back electrode 31, which applies a bias for guiding to the recording paper 101 subsequent to passage, it is impossible to set the spacing of toner controlling means 4 and the back electrode 31 extremely narrowly, but on the other hand, there is no need for a belt cleaning mechanism as in the above-mentioned second embodiment, and this constitution is advantageous for realizing a compact, low-cost image forming apparatus.

Figure 18A:
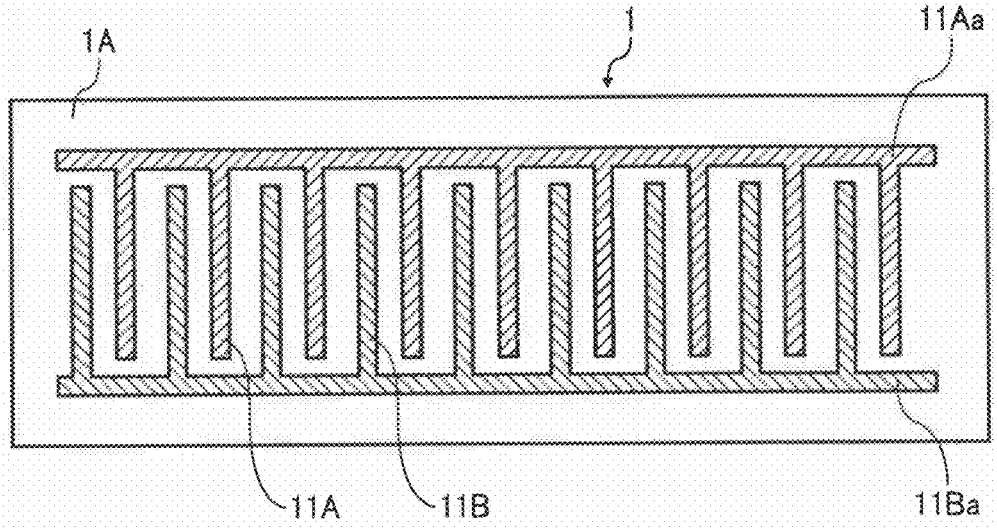
FIG. 18A is a plan view showing an example of the toner carrier in the deployed state.
Figure 18B:
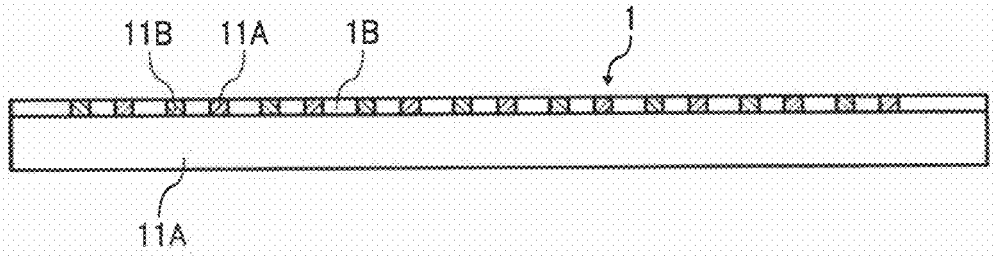
FIG. 18B is a cross-sectional view of the example of the toner carrier in the deployed state.

Next, an example of a toner carrier used in the above-described image forming apparatus will be explained by referring to FIGS. 18A and 18B. Furthermore, FIG. 18A is a schematic plan view showing the toner carrier in the deployed state, and FIG. 18B is a schematic cross-sectional view of the same toner carrier in the deployed state.

Figure 19:
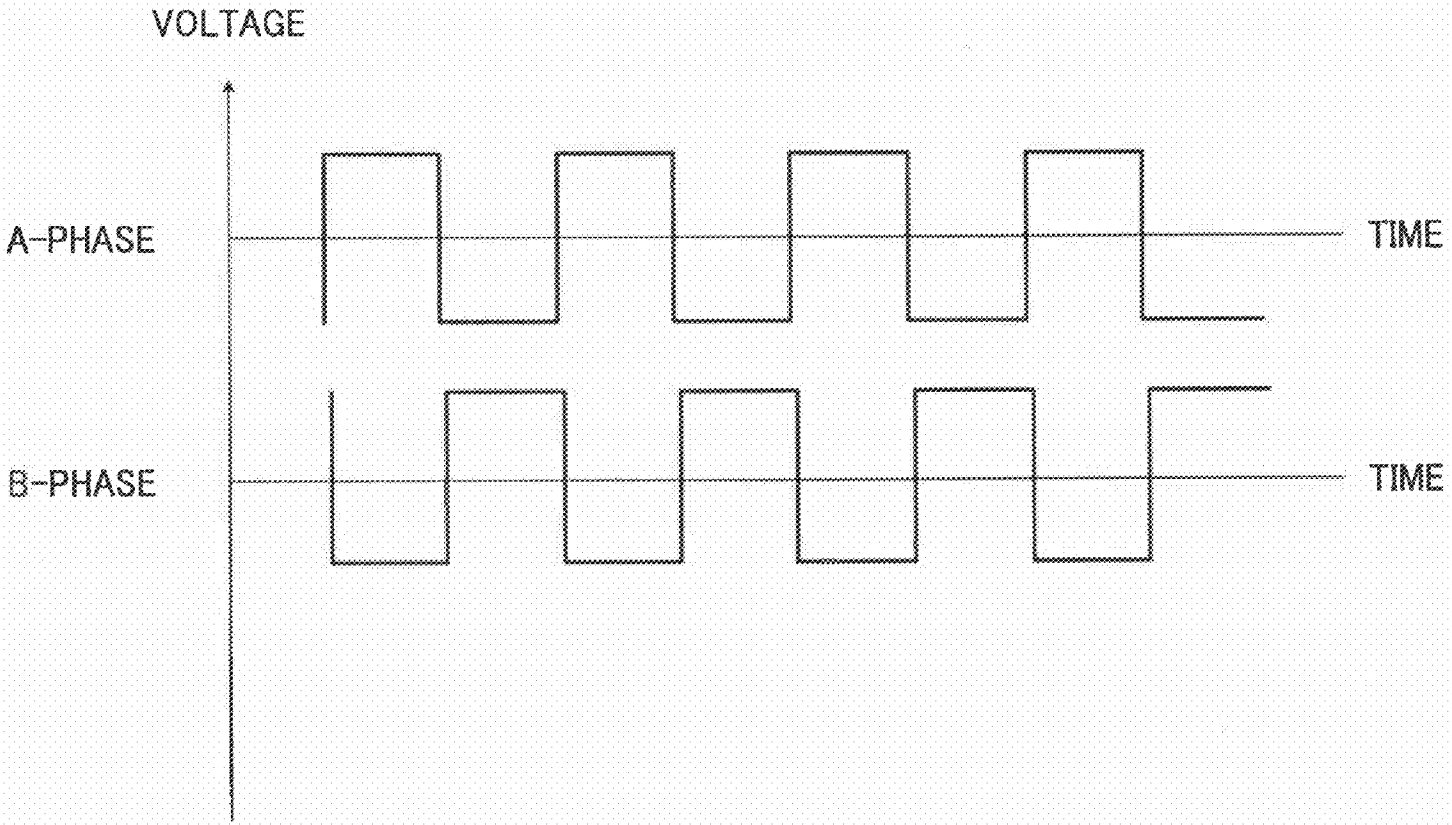
FIG. 19 is a diagram showing an example of pulse voltage applied to the electrode of the toner carrier.

This is an example of a toner carrier, which has a plurality of electrodes disposed on the surface of the toner carrier, comprises a two-phase electrode, which pairs together every other electrode, and applies a two-phase pulse (refer to FIG. 19) having a 180° phase difference to form a two-phase electric field that repeatedly generates attraction and repulsion forces between adjacent electrodes.

This toner carrier 1 has a constitution, which disposes an A-phase electrode 11A and a B-phase electrode 11B on the surface of an insulating board 1A as a plurality of electrodes 11, and disposes a surface protecting layer 1B thereon. The pectinate electrodes 11A, 11B are parallelly disposed at a micro-pitch in a direction that is orthogonal to the toner conveying direction, and are respectively connected to an external two-phase pulse generation circuit (voltage applying means 5) not shown in the figure by common bus lines 11Aa, 11Ba on both sides.

The pulse voltage applied to the electrodes 11A, 11B has a frequency of between 0.5 KHz and 7 KHz and comprises a DC voltage as a bias, and applies a pulse with a peak-to-peak value of from ±60V to ±300V in accordance with electrode width and electrode spacing. In the case of this two-phase field, toner repulsion flight and attraction flight is repeated in accordance with the switching of the direction of the field of the adjacent electrodes, and the toner moves back and forth between the reciprocal electrodes. Then, the entire toner carrier 1 moves in a rotating manner in the toner conveying direction.

Thus, by making the constitution such that means for causing the toner on the surface of the toner carrier to fly and form a cloud has a plurality of electrodes disposed on the surface of the toner carrier at a prescribe spacing that extends in the direction orthogonal to the toner conveying direction, the voltage, which is applied to the respective electrodes, applies voltages of a relationship that causes the toner to repeatedly move alternately in the attraction direction and the repulsion direction between adjacent electrodes, and the toner is conveyed and formed into a cloud by the toner carrier moving in a rotating manner, and when it comes to conveying the toner on the surface of the toner carrier, the toner can be conveyed stably without having to depend on the quality of the toner charge, making it possible to realize an image forming apparatus with overall high reliability.

Figure 20A:
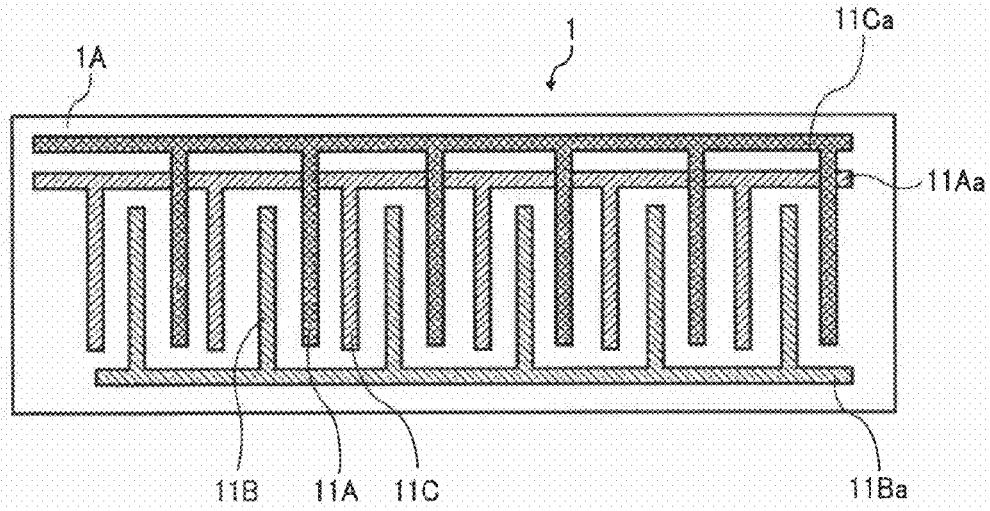
FIG. 20A is a plan view showing another example of the toner carrier in the deployed state.
Figure 20B:
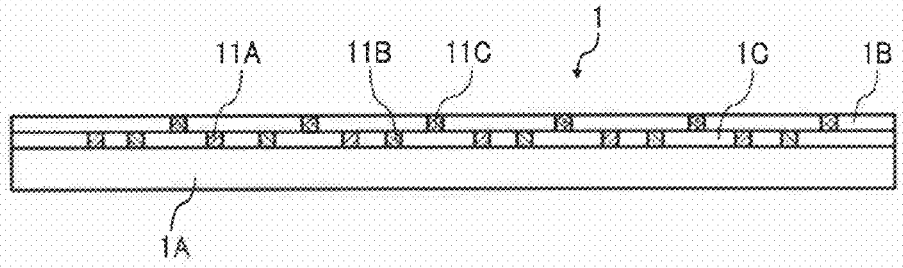
FIG. 20B is a cross-sectional view of the other example of the toner carrier in the deployed state.

Next, another example of the toner carrier used in the above-described image forming apparatus will be explained by referring to FIGS. 20A and 20B. Furthermore, FIG. 20A shows the toner carrier in a deployed state, and FIG. 20B shows a schematic cross-section of the same toner carrier in a deployed state.

This is an example of a toner carrier that forms a three-phase traveling wave field. After forming the A-phase and B-phase electrodes 11A, 11B on the insulating board 1A, and forming an insulating layer 1C thereon, a C-phase electrode 11C is formed and a surface protecting layer 1B is provided on top of this C-phase electrode 11C.

The respective ABC three-phase electrodes 11A, 11B, 11C are parallelly disposed at a micro-pitch in a direction that is orthogonal to the toner conveying direction, and are respectively connected to an external three-phase pulse generation circuit (not shown in the figure) by common bus lines 11Aa, 11Ba, 11Ca on both sides.

Figure 21:
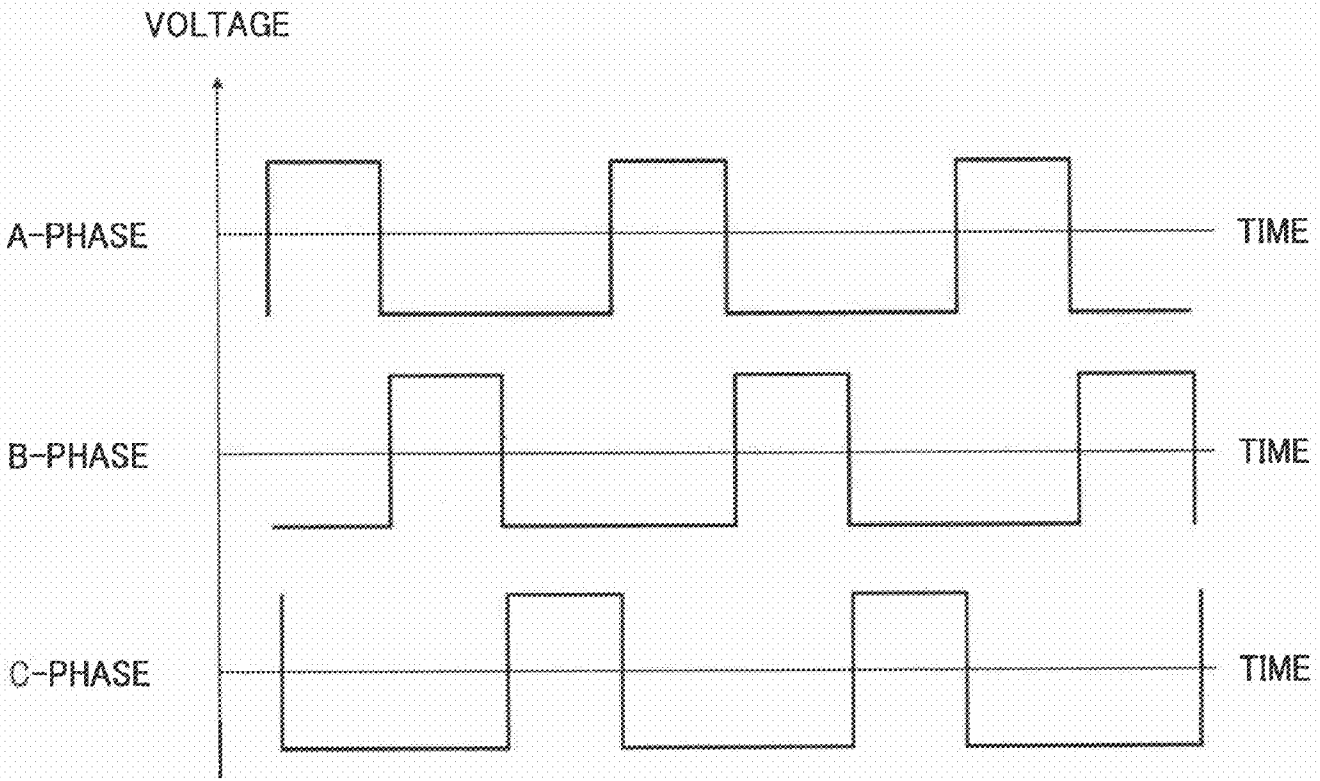
FIG. 21 is a diagram showing an example of pulse voltage applied to the electrode of the toner carrier.

When using this three-phase traveling wave field, as shown in FIG. 21, sequentially applying a pulse voltage that undergoes a 120° phase shift in a single cycle generates a traveling wave field, the field of which also sequentially shifts pursuant to the switching of the pulse at the surface of the toner carrier 1, and the charged toner repeatedly flies upward and is simultaneously conveyed in the direction in which the field is switched, and the toner carrier 1 can basically remain stationary as-is without rotating.

Thus, by making the constitution such that means for causing the toner on the surface of the toner carrier to fly and form a cloud has a plurality of electrodes disposed on the surface of the toner carrier at a prescribe spacing that extends in the direction orthogonal to the toner conveying direction, and the toner is conveyed and formed into a cloud by applying an n-phase voltage to the respective electrodes every n electrodes to form a traveling wave field between the reciprocal electrodes, and when it comes to conveying the toner on the surface of the toner carrier, since the part that conveys the toner does not need to be driven in a rotating manner, a flat, belt-shape is also possible, and the resultant freedom in terms of layout enables the overall apparatus to be made more compact and less expensive.

Further, when toner additives and other such micro particles are deposited on the surfaces of the electrodes during long periods of use, conveying reliability can be assured by cleaning the surface of the toner carrier 1 using a cleaning mode sequence carried out a times other than image formation. Cleaning is set up such that the cleaning components only make contact with the toner carrier 1 in the cleaning mode, and cleaning is carried out using a rotating brush, blade, suction slit and so forth. The pulse voltage applied to the electrodes 11A, 11B, 11C, the same as explained hereinabove, has a frequency of between 0.5 KHz and 7 KHz and comprises a DC voltage as a bias, and applies a pulse with peak-to-peak value of from ±60V to ±300V in accordance with electrode width and electrode spacing.

In the specific constitutions of these toner carriers 1, the insulating board 1A, which is the base board, for example, can use a board that comprises an insulating material such as a resin or ceramics, or a board that forms an insulating film, such as $SiO_2$ or the like on a base material comprising a conducting material such as aluminum or like, or a board comprising a flexible, deformable material such as polyimide film. Further, an electrode 11 can be formed by growing a film of a conducting material such as Al or Ni—Cr to a thickness of between 0.1 μm to 1 μm on top of the base board and using photolithography to pattern this film into the required electrode shape, or by stacking up copper foil and forming the electrode by plating, and thereafter using photolithography to carry out patterning.

The surface protecting layer 1B, for example, can be formed by using vapor deposition to grow a film of $SiO_2$, $TiO_2$, TiN, $Ta_2O_5$ or the like between 0.5 μm and 2 μm in thickness, or by printing and applying a 2 μm to 10 μm thin-film of an organic material such as polycarbonate, polyimide, methyl methacrylate or the like, and subjecting same to heat hardening.

In a toner carrier constituted like this, applying a flight pulse from a driving circuit to form a flight field subjects the charged toner on the toner carrier to a repulsion force and/or an attraction force, causing the toner to fly in the up-down direction and to be conveyed in the direction of the traveling wave.

Figure 22:
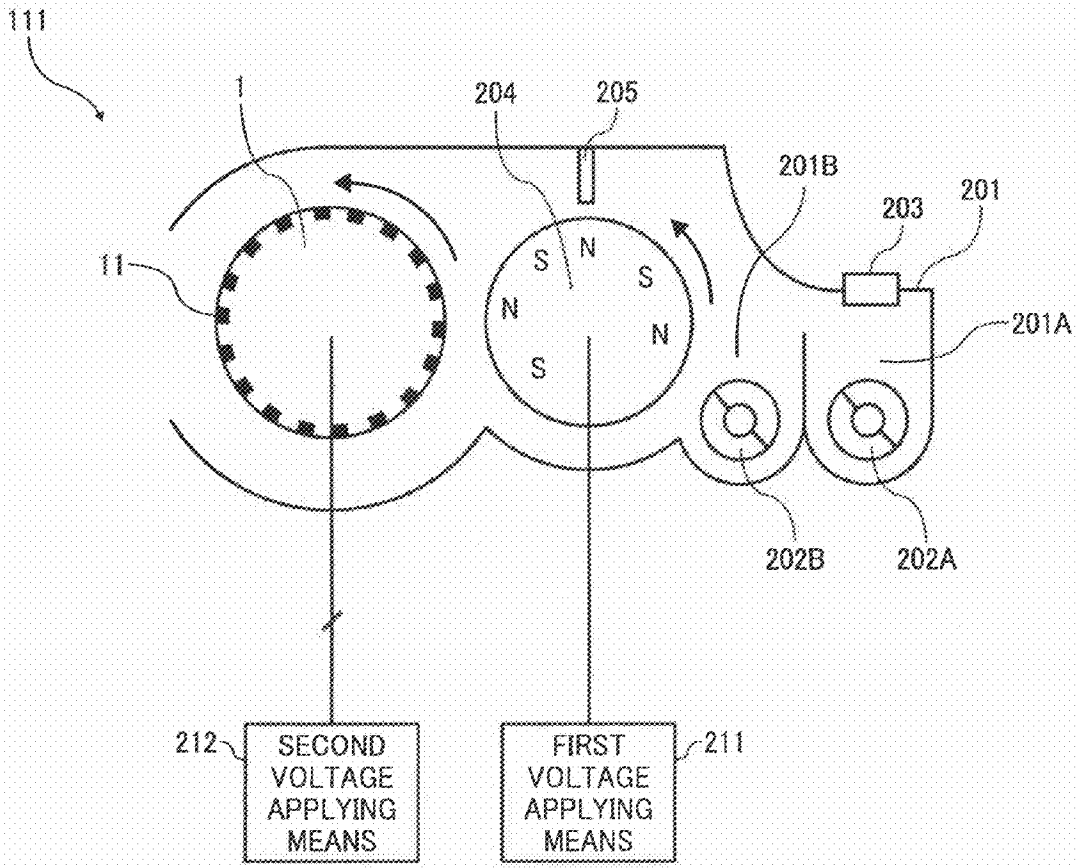
FIG. 22 is a diagram showing an example of the constitution of a toner supply unit.

Next, an example of a specific constitution of a toner supply unit 111 in the image forming apparatus described hereinabove will be explained by referring to FIG. 22.

This toner supply unit 111 is an example which uses a two-component recording agent comprising a magnetic carrier and a non-magnetic toner. A recording agent storage portion 201 is divided into two chambers 201A, 201B, and is connected to both ends of the inside of the toner supply unit 111 by a recording agent corridor (not shown in the figure). The two-component recording agent is stored in the recording agent storage portion 201, and is mixed and conveyed inside the recording agent storage portion 201 by mixing/conveying screws 202A, 202B in the respective chambers 201A, 201B.

A toner supply opening 203 is disposed in chamber 201A of the recording agent storage portion 201, and toner is supplied to the inside of the recording agent storage portion 201 through the toner supply opening 203 from a toner storage portion not shown in the figure. A toner concentration sensor not shown in the figure is installed in the recording agent storage portion 201 for detecting the magnetic permeability of the recording agent, and detects the concentration of the recording agent. When the concentration of the toner in the recording agent storage portion 201 decreases, toner is supplied to the inside of the recording agent storage portion 201 from the toner supply opening 203.

Then, a magnetic brush roller 204 is disposed as a toner supply roller in a location facing mixing/conveying screw 202B. Fixed magnets are disposed on the inside of the magnetic brush roller 204, and the recording agent inside the recording agent storage portion 201 is drawn up to the surface of the magnetic brush roller 204 by the rotation and magnetic force of the magnetic brush roller 204. A recording agent level controlling member 205 is provided in a location facing the magnetic brush roller 204 upstream from the recording agent draw-up location in the direction of the rotation of the magnetic brush roller 204.

The recording agent drawn up at the draw-up location is controlled to a fixed thickness by the recording agent level controlling member 205. The recording agent that passes by the recording agent level controlling member 205 is conveyed to a location opposite the toner carrier 1 in line with the rotation of the magnetic brush roller 204. A supplying bias is applied to the magnetic brush roller 204 by first voltage applying means 211.

In the toner carrier 1, the voltage shown in the above-mentioned FIG. 12 or FIGS. 14A and 14B is applied to the electrodes 11 by second voltage applying means 212. An electric field is generated between the toner carrier 1 and the magnetic brush roller 204 in a location opposite the magnetic brush roller 204 by first and second voltage applying means 211, 212. Subjected to the electrostatic force from this field, the toner separates from the carrier and moves to the surface of the toner carrier 1. The toner that reaches the toner carrier 1 surface is formed into a cloud by an electric field formed by a voltage applied to the electrodes 11 from second voltage applying means 212, and is conveyed either by the rotation of the toner carrier 1, or the traveling wave field of the toner carrier 1.

Then, the toner that is conveyed to a location opposite toner controlling means 4 is selectively made to fly to the recording medium means side by the toner passage ON/OFF control field of the control electrode 42, and toner dot printing is controlled.

Figure 23:
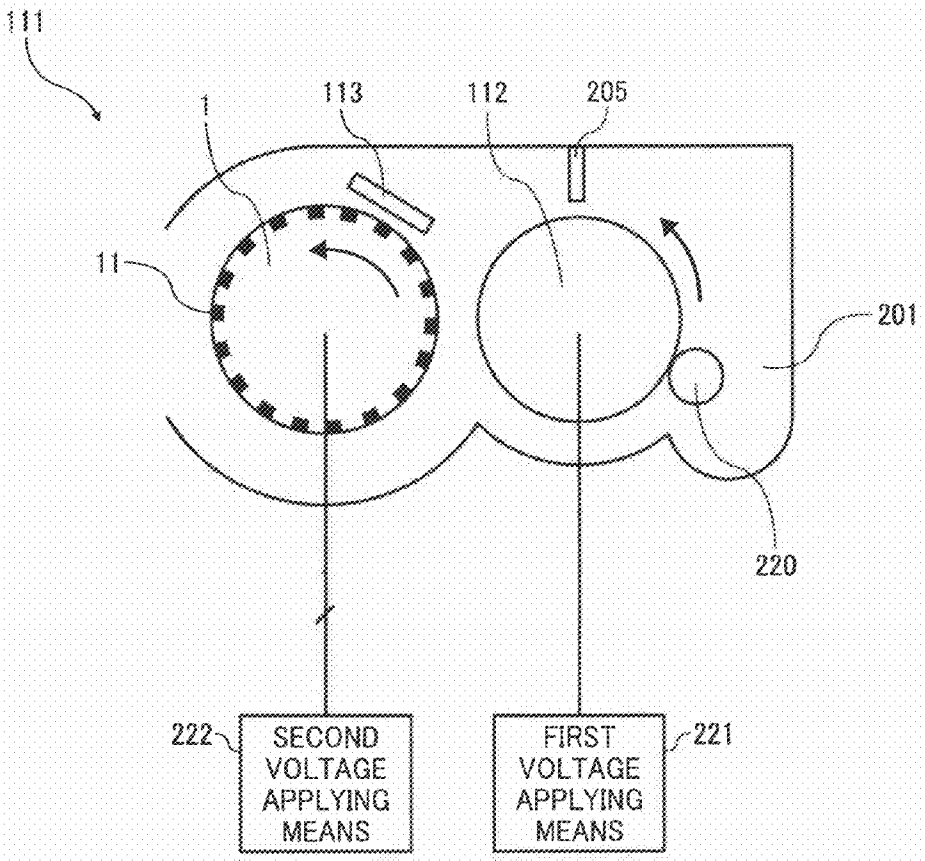
FIG. 23 is a diagram showing another example of the constitution of a toner supply unit.

Next, another example of a specific constitution of the toner supply unit 111 of the above-described image forming apparatus will be explained by referring to FIG. 23.

This toner supply unit 111 is an example of a single component recording agent comprising a non-magnetic toner. The toner is stored in a recording agent storage portion 201, and the toner is subjected to frictional electrification with a toner supply roller 112 by a charging roller 220, and drawn up onto the toner supply roller 112 by an electrostatic force. The toner on the toner supply roller 112 is maintained at a thin layer by a recording agent level controlling member 205, and conveyed to a location opposite the toner carrier 1 in line with the rotation of the toner supply roller 112.

A supplying bias is applied to the toner supply roller 112 by first voltage applying means 221 at this time. In the toner carrier 1, a voltage is applied to the electrodes 11 by second voltage applying means 222. Therefore, at a location opposite the toner carrier 1, an electric field is generated between the toner carrier 1 and the toner supply roller 112 by first and second voltage applying means 221, 222, and upon being subjected to the electrostatic force from this field, the toner separates from the toner supply roller 112 and moves to the surface of the toner carrier 1.

The same as in the example described hereinabove, the toner that reaches the surface of the carrier toner 1 is formed into a cloud by an electric field formed by a voltage applied to the electrodes 11 from second voltage applying means 222, and is conveyed either by the rotation of the toner carrier 1, or the traveling wave field of the toner carrier 1.

Then, the toner that is conveyed to a location opposite toner controlling means 4 is selectively made to fly to the recording medium means side by the toner passage ON/OFF control field of the control electrode 42, and toner dot printing is controlled.

Furthermore, in these respective toner supply units 111, toner that does not contribute to imaging is conveyed yet further by the toner carrier 1, and is recovered from the surface of the toner carrier 1 by recovering means not shown in the figure. The recovered toner is returned once again to the recording agent storage portion 201 and circulated around inside the toner supply unit 111.

Furthermore, mainly negatively charged toner is used in the examples explained hereinabove, but positively charged toner can also be used.

Figure 24:
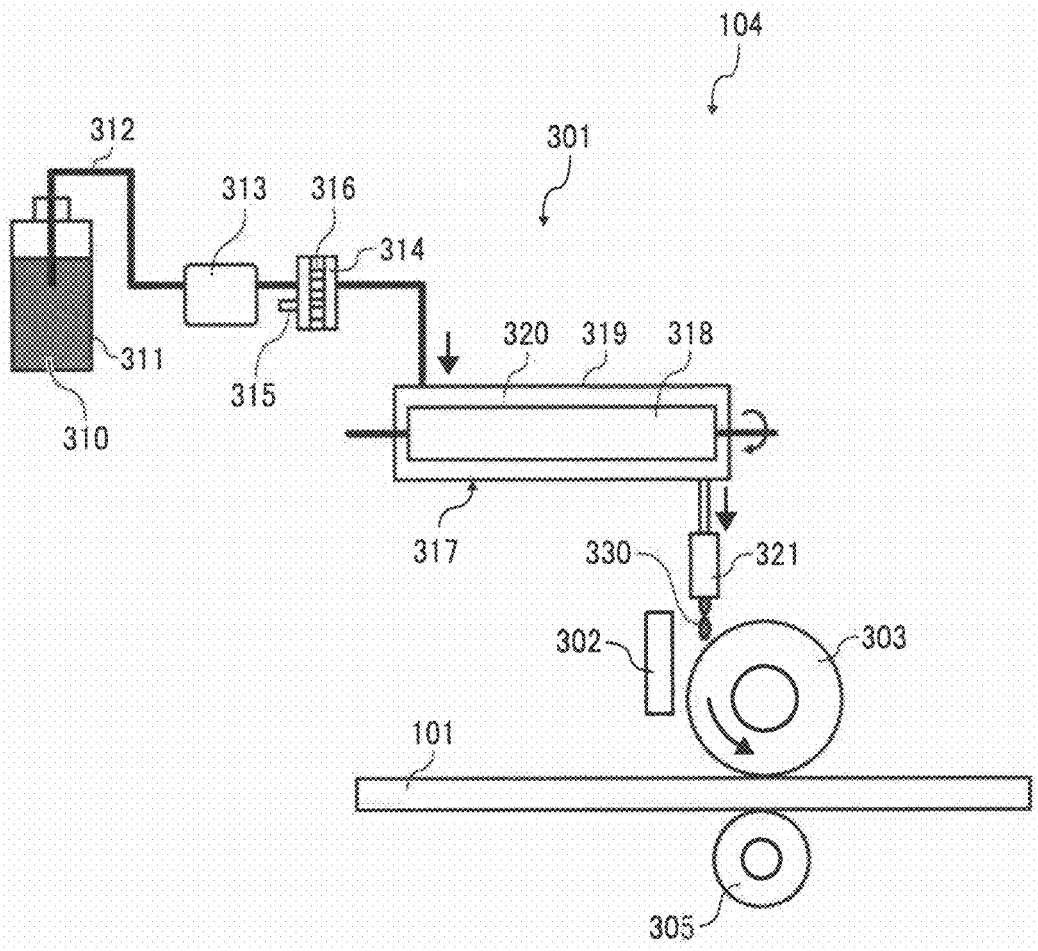
FIG. 24 is a diagram showing a first example of the constitution of either liquid applying means or liquid applying/humidifying means.
Figure 25:
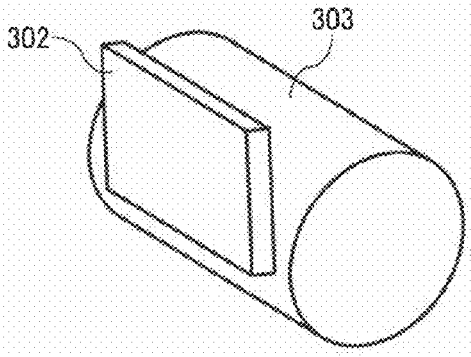
FIG. 25 is an oblique view showing the essential parts of either liquid applying means or liquid applying/humidifying means.

Next, a first example of liquid applying means 104 will be explained by referring to FIGS. 24 and 25. Furthermore, FIG. 24 schematically shows a constitution of liquid applying means 104, and FIG. 25 is an oblique view showing the essential part of liquid applying means 104.

When applying an application liquid, which contains a softening agent for softening the toner on the imaging surface of recording medium means by either dissolving or swelling the resin comprised in the toner, using a foam application liquid that is made up of bubbles makes it possible to lower the apparent density of the liquid and facilitates setting the thickness of the application liquid layer on an application roller or other such applying means, resulting in the possibility of applying a tiny amount of application liquid to the surface (imaging surface) of recording medium means.

To simultaneously achieve the effects of applying a small amount of application liquid to recording medium means and curbing toner spatter, the diameter of the bubbles of the foam application liquid must range from around 5 μm to 50 μm.

Generally speaking, in the case of large bubbles of from 0.5 mm to 1 mm, bubbles can be relatively easily produced by simply mixing the liquid, and these large bubbles can be produced in less than one second time (it takes less than 0.1 second). Accordingly, keeping in mind that bubbles that are larger than the desired bubble diameter (bubbles of a size that can be observed with the naked eye) are easy to produce, and, in addition, can be produced quickly, micro-bubbles of from 5 μm to around 50 μm are produced in a short period of time from larger bubbles. In this case, dividing large bubbles by applying shearing force to the large bubbles makes it possible to produce micro-bubbles of the desired size in an extremely shorter period of time than a method that foams micro-bubbles from the liquid state.

Furthermore, it is preferable that the apparent density of the foam application liquid range from 0.01 g/cm$^3$ to 0.1 g/cm$^3$. Furthermore, the application liquid should be a foam when applied to the recording paper or other such recording medium means, but it is not necessary for the application liquid to be a foam inside the storage container. It is preferable that the application liquid does not comprise bubbles inside the storage container, and that the constitution provide means for foaming the application liquid when the liquid is supplied from the storage container, or along the liquid conveying route up to being applied on the imaging surface. This is because a constitution that maintains the application liquid as a liquid in the storage container, and makes this liquid into a foam after the liquid has been extracted from the storage container offers the big advantage of enabling the storage container to be made small.

Accordingly, liquid applying means 104 has liquid producing means 301 for producing a foam liquid; film thickness regulating means 302 for regulating the film thickness of the produced foam liquid; and an application roller 303 as applying means for applying the film-thickness regulated foam liquid to the surface of recording medium means 3 (will be explained using recording paper 101 here).

Liquid producing means 301 uses liquid transporting means 313, such as a conveying pump or the like, to supply a liquid-state application liquid 310 inside an application liquid container 311 to a gas/liquid mixer 314 via a liquid feeding pipe 312. The gas/liquid mixer 314 has an air inlet 315, the flow of the liquid 310 generates negative pressure in the air inlet 315, a gas is introduced into the gas/liquid mixer 314 from the air inlet 315, the liquid 310 is mixed with the gas, and passes through a porous sheet 316, producing big bubbles having uniform bubble diameters. It is preferable that the diameter of the pores range from 30 μm to 100 μm, but the present invention is not limited to a porous sheet 316, and any porous member having continuous bubble structure will work, and a sintered ceramics, nonwoven fabric or resin foam sheet having pore diameters of between 30 μm to 100 μm can be used.

Furthermore, as a method for producing big bubbles, a constitution that uses a bladed mixer to mix the air from the air inlet 315 with the liquid-state application liquid 310 supplied from liquid transporting means 313 such as the above-mentioned conveying pump and produce large bubbles while incorporating air bubbles into the liquid, or a constitution that produces big bubbles by using an air supply pump to carry our bubbling in the liquid-state application liquid 310 supplied from the above-mentioned liquid transporting means 313 can be used.

The big bubbles produced by this gas/liquid mixer 314 are sent to bubble producing means 317 through liquid feed pipe 312. In bubble producing means 317, shearing force is applied to the big bubbles to split the big bubbles to form two or more bubbles. That is, bubble producing means 317 has a closed inner cylinder 318 and an outer cylinder 319, makes the inner cylinder 318*a* rotatable constitution, and uses the rotating inner cylinder 318 to apply shearing force to bubbles while supplying a large bubble-like application liquid from one part of the outer cylinder 319 and allowing this bubble-like application liquid to pass through a gap 320 (constitutes a flow channel here) between the inner cylinder 318 rotating on the inside and the outer cylinder 319, which is either fixed or rotating in the opposite direction. This shearing force changes the large bubbles to micro-bubbles, producing a foam application liquid 330 having the desired micro-bubble diameter from a bubble outlet 321 provided in the outer cylinder 319.

The liquid conveying velocity here is determined by the number of revolutions of the rotating inner cylinder 318 and the length of the cylinders. If it is assumed that the inner diameter of the outer cylinder 319 is d1 (mm), the cylinder length is L (mm), the outer diameter of the inner cylinder 318 is d2 (mm), and the number of revolutions is R (rpm), the liquid conveying velocity V (mm$^3$/seconds) for producing micro-bubbles is determined by the equation:

$$V=L\times\Pi\times(d12-d22)/4/(1000/R)$$

For example, if it is assumed that d1 is 10 mm, d2 is 8 mm, L is 50 mm and the number of revolutions is 1000 rpm, the liquid conveying velocity becomes roughly 1400 mm$^3$/second (1.4 cc/second). If it is supposed that 3 cc of foam application liquid is needed for applying to a A4-size sheet of paper, it will only take two seconds of rise time to produce the required amount of foam application liquid from the liquid-state application liquid, making it possible to produce foam application liquid 330 having the desired bubble diameter extremely quickly.

In this case, the liquid conveyability inside bubble producing means 317 can be enhanced by disposing a spiral-shaped groove in the inner cylinder 318.

Thus, by combining a mechanism that changes a liquid-state application liquid to a liquid having large diameter bubbles with a constitution that applies shearing force to large bubbles, a foam application liquid having micro-bubbles with diameters from 5 μm to around 50 μm can be produced from the liquid-state application liquid in an extremely short period of time.

Then, the foam application liquid 330 produced by foam producing means 317 of liquid producing means 301 is dripped onto the application roller 303, the film thickness is regulated to the desired thickness by the film thickness control blade (film thickness regulating means) 302, and the foam application liquid 330 on the surface of the application roller 303 is brought into contact with and applied to the recording paper 101 by the rotation of the application roller 303. Furthermore, a pressure roller 305, which presses the recording paper 101 against the application roller 303 side, is disposed opposite the application roller 303.

Figure 26:
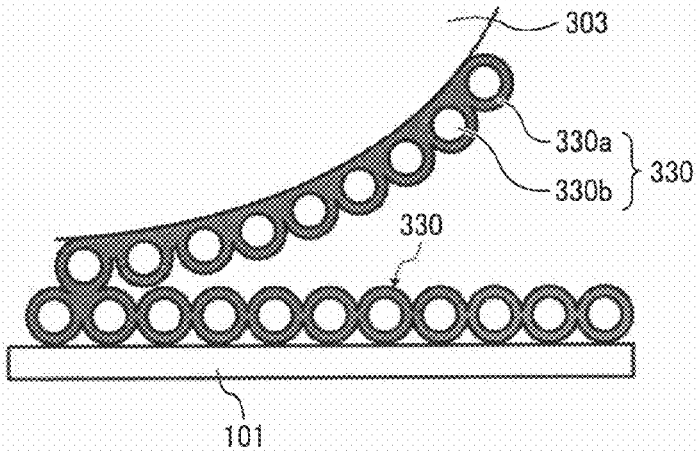
FIG. 26 is a diagram illustrating the application state of a foam application liquid of either liquid applying means or liquid applying/humidifying means.
Figure 27:
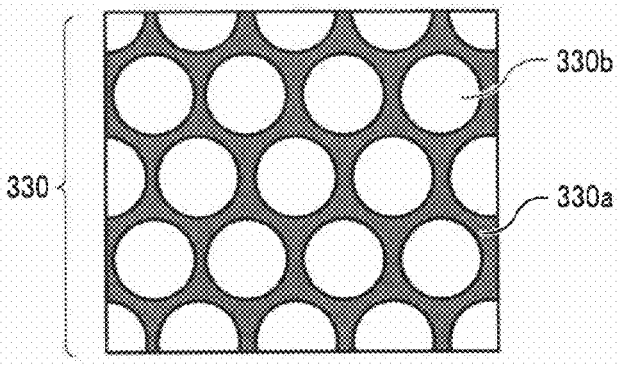
FIG. 27 is a diagram illustrating the foam application liquid of either liquid applying means or liquid applying/humidifying means.

In so doing, a layer of foam application liquid 330 is formed on the peripheral surface of the application roller 303 as shown in FIG. 26, and the foam application liquid 330 is transferred and applied to the recording paper 101 by the rotation in the direction of the arrow (refer to FIG. 24) of the application roller 303, which is in contact with the recording paper 101. Here, the foam application liquid 330, which is made up of bubbles, is constituted from a liquid film boundary (plateau boundary) 330*a*, which partitions one air bubble 330*b* from another air bubble 330*b* as shown in FIG. 27.

Figure 28B:
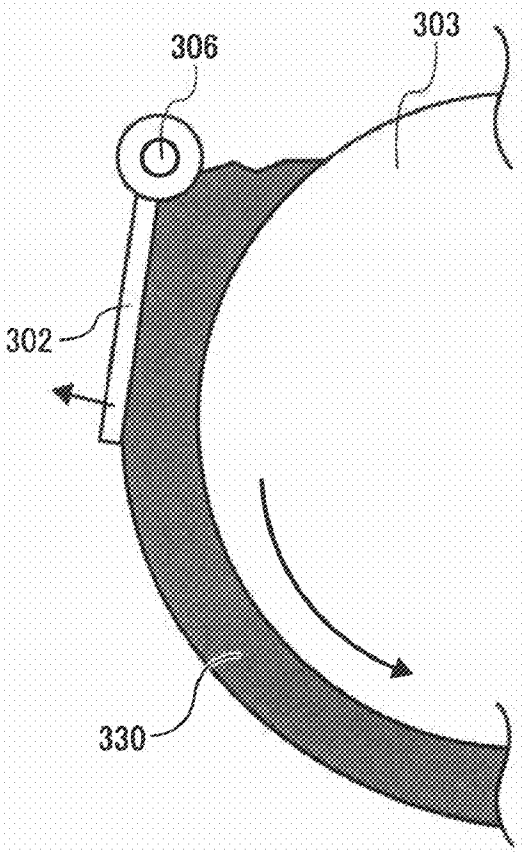
FIGS. 28A and 28B are diagrams illustrating the thickness control of the foam application liquid of either liquid applying means or liquid applying/humidifying means.
Figure 28A:
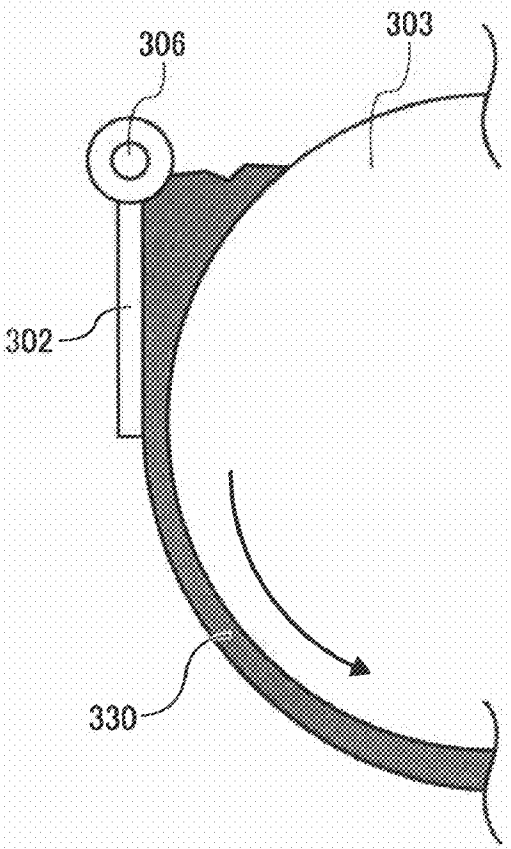

Furthermore, it is preferable that the film thickness of the foam application liquid 330 on the application roller 303 be able to change in accordance with the contact pressure applied to the recording paper 101 by the application roller 303. In this case, as shown in FIGS. 28A and 28B, the film thickness control blade 302 is affixed to a rotating shaft 306, and the rotating shaft 306 causes the film thickness control blade 302 to swing, thereby changing the gap between the film thickness control blade 302 and the application roller 303. For example, as shown in FIG. 28A, when making the film thickness thin, the gap between the film thickness control blade 302 and the application roller 303 is narrowed, and when making the film thickness thick, as shown in FIG. 28B, the gap between the film thickness control blade 302 and the application roller 303 is widened by swinging the film thickness control blade 302 in the direction of the arrow.

Further, in the example described above, a conveying pump or other such liquid transporting means 313 is used as means for conveying the liquid-state application liquid 310 from the application liquid container 311 to bubble-making mechanism. As the conveying pump, there is a gear pump, a bellows pump and so forth, but a tube pump is preferable. The tube pump is a mechanism that pushes the liquid inside a tube out by deforming the tube, and as such, the only member that comes in contact with the application liquid is the tube, using a tube member that is liquid-resistant to the application liquid prevents the pollution of the liquid and the deterioration of the pump parts. Further, since the tube is merely deformed, the liquid is not foamed, thereby making it possible to prevent a drop in conveying capacity.

Further, controlling (regulating) the thickness of the foam application liquid 330 film on the application roller 303 can be done using a wire bar instead of a film thickness control blade 302. Using a wire bar as film thickness controlling means (film thickness regulating means) makes it possible to enhance the uniformity of the film thickness of the foam application liquid 330 in the radial direction on the surface of the application roller 303 more than with the blade 302.

Figure 29:
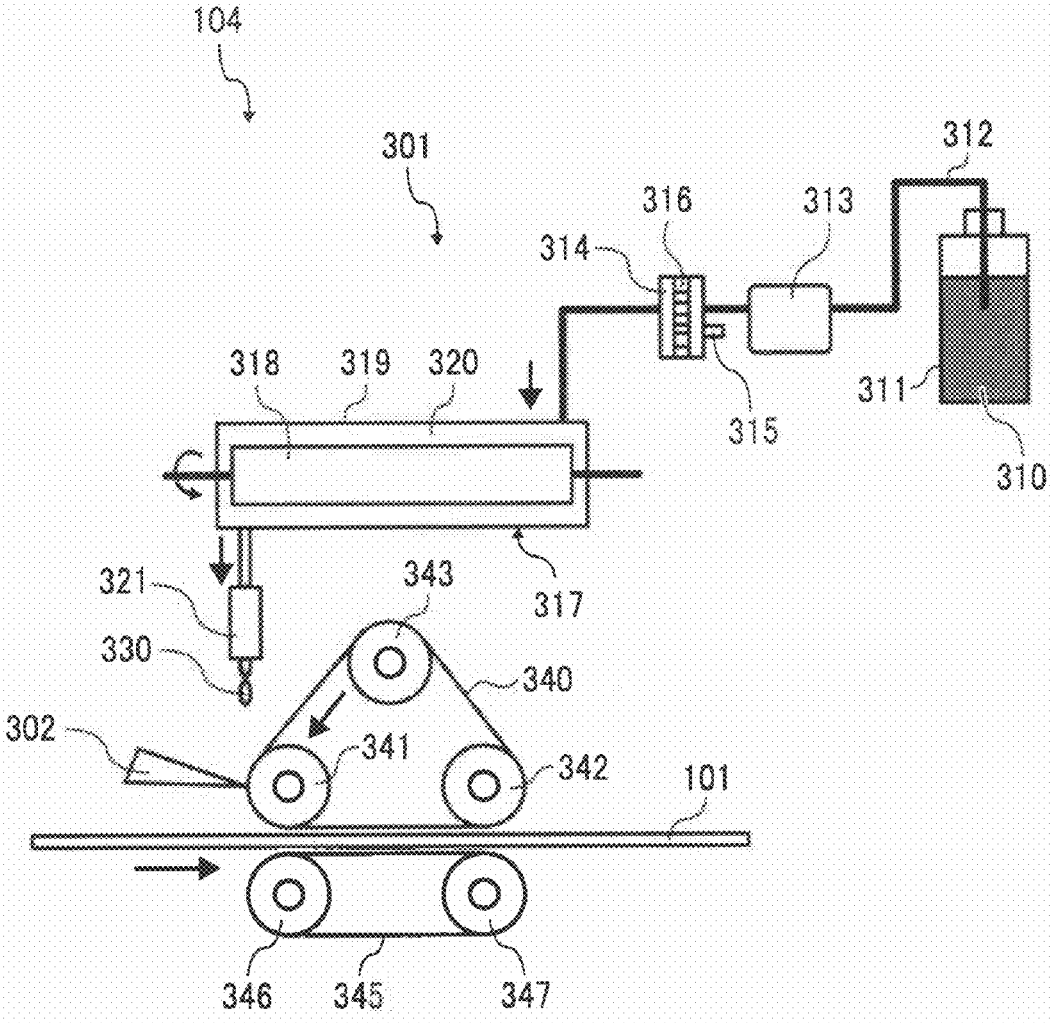
FIG. 29 is a diagram showing a second example of the constitution of either liquid applying means or liquid applying/humidifying means.

Next, a second example of liquid applying means 104 will be explained by referring to FIG. 29. Furthermore, FIG. 29 schematically shows the constitution of liquid applying means 104.

In this example, an application belt 340 is used as liquid applying means instead of an application roller. As the application belt 340, for example, a member such as a seamless nickel belt or seamless PET file is used. This application belt 340 is suspended around rollers 341 through 343, moves in a rotating manner in the direction of the arrow, and makes contact with the recording paper 101 as recording medium means between rollers 341 and 342. Further, a pressure belt 345 suspended around rollers 346 and 347 is disposed in a location opposite the application belt 340 by way of the recording paper 101, and serves to press the recording paper 101 against the application belt 340 side.

In this constitution, too, the foam application liquid 330 produced by liquid producing means 301 is dripped onto the application belt 340, the gap between the blade 302 and the application belt 340 is adjusted, the thickness of the layer of foam application liquid 330 on the application belt 340 is controlled, and thereafter, the foam application liquid 330 is applied to the imaging surface of the recording paper 101.

In a constitution that uses an application belt like this, the nip width can be readily widened, making it possible to save time humidifying. Furthermore, it is also possible to use a constitution in which an application belt is used as liquid applying means and a pressure roller is used instead of a belt on the pressure application side, and it is also possible to use a constitution in which an application roller is used as liquid applying means and a belt is used on the pressure application side.

It is preferable here that the foam application liquid, which produces the full effect for achieving high quality images that curb toner spatter, be a continuous foam state on the surface of liquid applying means, such as the application roller or application belt described hereinabove.

Figure 30:
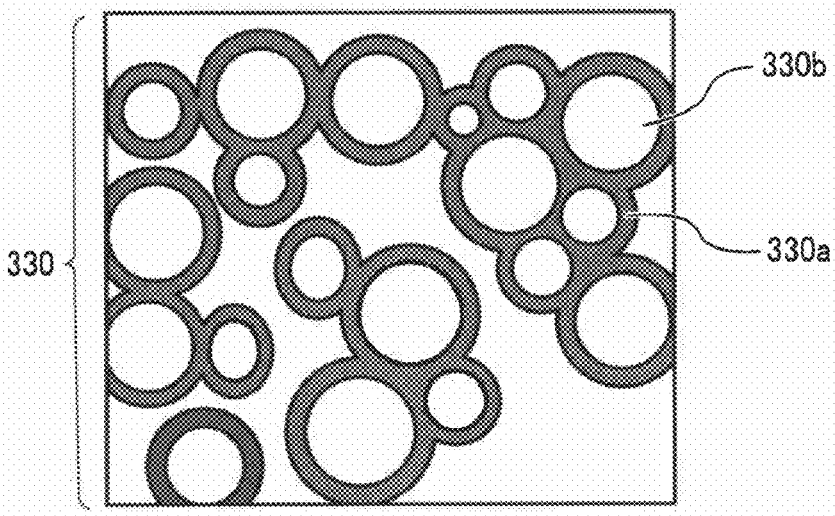
FIG. 30 is a diagram illustrating the foam application liquid in a discontinuous state.
Figure 31:
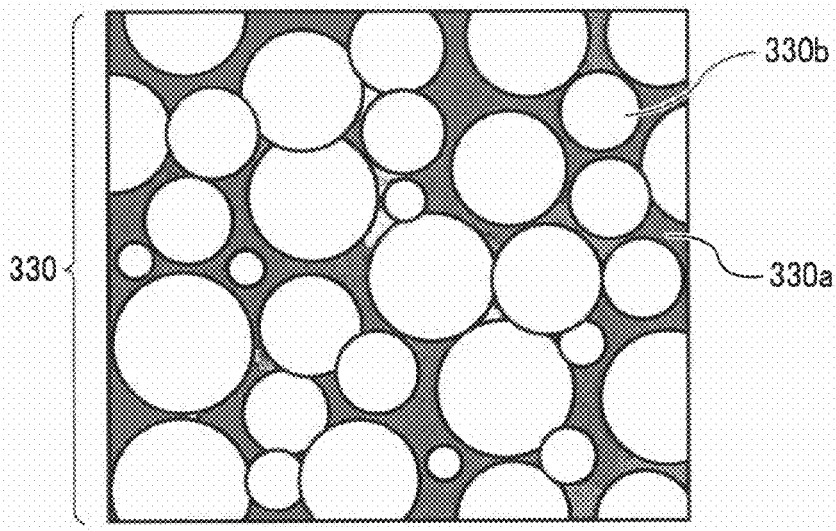
FIG. 31 is a diagram illustrating the foam application liquid in a continuous state.

That is, even though the effect of humidification is there when transferring an image to recording medium means and the foam is spread out on recording medium means in a state in which the liquid 330*a* comprising the air bubbles 330*b* is discontinuous as shown in FIG. 30, the more preferable state for producing further effects for toner spatter is one in which a continuous foam state is maintain on the surface of liquid applying means as shown in FIG. 31. Then, it is more preferable that this continuous foam state account for more than 80% of the surface of liquid applying means.

In order to form this continuous foam state, processing that makes the surface of liquid applying means (the application roller or application belt) hydrophilic and rough can be carried out. As a hydrophilic film, for example, a layer of silane coupling agent around 5 μm thick can be formed, or an approximately 5 μm-thick hydrophilic film having titanium oxide as the photocatalyst can be formed, or a hydrophilic surface can be achieved by using a sandblasting process to roughen the surface on an aluminum roller. When roughening the surface, since a bubble diameter>surface roughness relationship is preferable, the average surface roughness should be 5 μm or less at the least.

Further, forming a continuous foam state, and, in addition, maintaining a state in which the bubbles on the surface of liquid applying means do not burst over time (outstanding foam stability) makes it possible to maintain a continuous bubble state (foam state) after transferring an image to recording medium means, thereby enhancing the toner spatter curbing effect. It is preferable that the application liquid formulation for this purpose comprise a bubble augmentation agent. More specifically, it is preferable that the application liquid comprise a fatty acid alkanolamide with a molar ratio of 1:1. There are fatty acid alkanolamides with 1:1 and 1:2 molar ratios, and the 1:1 fatty acid alkanolamide has been confirmed to be suitable for foam stability.

Next, the liquid formulation of the application liquid will be explained. The foam application liquid is a constitution comprising air bubbles inside a liquid that comprises a foaming agent. Here, the application liquid comprises a softening agent for softening the toner by either dissolving or swelling the resin in the toner. It is preferable that the liquid comprising a foaming agent have a bubble augmentation agent to produce a foam, which stably comprises air bubbles, and which constitutes a layer of air bubbles comprising air bubbles that are of uniform size as much as possible. Further, it is preferable that the liquid formulation comprise a thickening agent because a certain degree of high viscosity will stabilize the air bubbles dispersed inside the liquid.

As the foaming agent, an anion surface-active agent, and particularly, a fatty acid salt is preferable. Since a fatty acid salt is surface active, this fatty acid salt lowers the surface tension of an application liquid that comprises water, and facilitates the foaming of the application liquid, and, in addition, the fatty acid salt adopts a stratified lamellar structure on the surface of the bubbles, thereby strengthening the bubble wall (plateau boundary) more than other surface active agents and making for extremely high foam stability, and to make the foamability of the fatty acid salt effective, it is preferable that the application liquid comprise water.

As the fatty acid, a saturated fatty acid that resists oxidation is preferable from the standpoint of long-term stability in the atmosphere. However, comprising a little unsaturated fatty acid salt in the application liquid that comprises a saturated fatty acid salt can assist the solubility and dispersibility of the fatty acid salt in the water, and can have outstanding foamability at low temperatures from 5° C. to 15° C., making stably foaming possible across a wide range of ambient temperatures, and can prevent the dispersion of the fatty acid salt inside the application liquid while the application liquid is left as-is (not used) for a long time.

As the fatty acid used in the saturated fatty acid salt, a saturated fatty acid with a carbon number of 12, 14, 16 and 18, more specifically, lauric acid, myristic acid, palmitic acid and stearic acid are suitable. A saturated fatty acid salt with a carbon number lower than 11 has a strong odor, and is not suitable for use in this application liquid for an image forming machine to be used in an office or home. Further, a saturated fatty acid with a carbon number of 19 or higher has low solubility in water, and will notably reduce the shelf stability of the application liquid. A saturated fatty acid salt based on these saturated fatty acids is used either singly or in a mixture as a foaming agent.

Furthermore, an unsaturated fatty acid salt can also be used, and an unsaturated fatty acid with a carbon number of 18 and between one and three double bonds is preferable. More specifically, oleic acid, linoleic acid and linolenic acid are suitable. Since an unsaturated fatty acid with four or more double bonds has strong reactivity, the shelf stability of the application liquid will deteriorate. An unsaturated fatty acid salt based on these unsaturated fatty acids is used either singly or in a mixture as a foaming agent. Further, the above-mentioned saturated fatty acid salts and unsaturated fatty acid salts can also be mixed together and used as a foaming agent.

Further, when the above-mentioned saturated fatty acid salt or unsaturated fatty acid salt is used as the foaming agent in this application liquid, a sodium salt, potassium salt or amino salt is preferable. Being able to apply the application liquid right after powering ON the application device is an important element for the product value of the application device. For liquid applying means 104 (the application device here) to be in an application-enabled state, it is essential that the application liquid has made the transition to a suitable foam, and quickly foaming the above-mentioned fatty acid salt makes it possible to create an application-enabled state shortly after powering ON. Using amino salt in particular makes it possible to commence foaming in the shortest time once a shearing force has been applied to the application liquid and to readily manufacture the foam application liquid, enabling the transition to an application-enabled state shortly after powering ON the application device.

The softening agent, which softens the toner by either dissolving or swelling the toner resin, comprises an aliphatic ester. This aliphatic ester has outstanding solubility or swellability for either dissolving or swelling at least a part of the resin in the toner and so forth.

Further, from the standpoint of human safety, it is preferable that the softening agent have an acute oral toxicity LD50 of greater than 3 g/kg, and more preferably of 5 g/kg. The aliphatic ester is highly safe for humans as it is being widely used as a raw material in cosmetics.

Furthermore, the fixing of the toner to recording medium means is carried out by a machine that is frequently used in a sealed environment, and since the softening agent remains inside the toner even after the toner has been fixed to the recording medium, it is preferable that the fixing of the toner to the recording medium not involve volatile organic compounds (VOC) and the generation of an unpleasant odor. That is, it is preferable that the softening agent not comprise a volatile organic compound (VOC) or a substance that causes an unpleasant odor. The aliphatic ester generally has a higher boiling point and lower volatility than the organic solvents in general use (such as toluene, xylene, methyl ethyl ketone and ethyl acetate), and does not have an irritating smell.

In the application liquid of the present invention, preferably the above-mentioned aliphatic ester comprises a saturated aliphatic ester. When the above-mentioned aliphatic ester comprises a saturated aliphatic ester, it is possible to enhance the storage stability (resistance to oxidation and hydrolysis) of the softening agent. Further, a saturated aliphatic ester is highly safe for humans, and most saturated aliphatic esters can either dissolve or swell the resin in the toner within one second. Furthermore, a saturated aliphatic ester can reduce the stickiness of the toner provided to the recording medium. This is believed to be because a saturated aliphatic ester forms an oil film on the surfaces of the toner particles once the resin has either been dissolved or swollen.

For the application liquid of the present invention, preferably the above-mentioned aliphatic ester comprises an aliphatic dicarboxylic acid dialkoxyalkyl. When the above-mentioned aliphatic ester comprises an aliphatic dicarboxylic acid dialkoxyalkyl, it is possible to enhance the fixability of the toner to the recording medium.

For the application liquid of the present invention, preferably the general expression for the above-mentioned aliphatic dicarboxylic acid dialkoxyalkyl comprises a compound expressed as

R5(COOR6-O—R7)2 where R5 is an alkylene group having a carbon number of greater than 2 but less than 8, R6 is an alkylene group having a carbon number of greater than 2 but less than 4, and R7 is an alkyl group having a carbon number of greater than 1 but less than 4. When the carbon numbers of R5 and R6 are both less than the desired range, these alylene groups give off on odor, and when the carbon numbers of R5 and R6 are greater than the desired range, the ability to soften resin is reduced.

That is, when the above-mentioned aliphatic dicarboxylic acid dialkoxyalkyl comprises a compound that is expressed as R5 (COOR6-)-R7)2, and R5 is an alkylene group having a carbon number of greater than 2 but less than 8, R6 is an alkylene group having a carbon number of greater than 2 but less than 4, and R7 is an alkyl group having a carbon number of greater than 1 but less than 4, it is possible to enhance either the solubility or the swellability relative to the resin in the toner. Further, the odor index of the above-mentioned compound is less than 10, and the above-mentioned compound does not have an unpleasant smell or irritating odor.

Aliphatic dicarboxylic acid dialkoxyalkyls, which comprise the above-mentioned compound, for example, include diethoxyethyl succinate, dibutoxyethyl succinate, diethoxyethyl adipate, dibutoxyethyl adipate and diethoxyethyl sebacate. For an aqueous solvent, these aliphatic dicarboxylic acid dialkoxyalkyls are contained in the application liquid as glycol-type dissolver aids, and are configured as dissolvers or microemulsions.

Further, although not a fatty acid ester, citric ester, ethylene carbonate, and propylene carbonate are also suitable as either a softener or swelling agent.

Of the particles comprising the above-mentioned resins, combining a toner, which is used in digital photography, with the application liquid of the present invention achieves the highest fixing effect. The toner comprises resins, like a coloring material, electrification regulatory agent, bonding resin and mold release agent. The resins that can be comprised in the toner are not particularly limited, good bonding agents include polystyrene resin, styrene-acrylic copolymer resin, polyester resin and so forth, and mold release agents, for example, include carnauba wax or wax components such as polyethylene. The toner can also comprise a well-known coloring agent, charge regulatory agent, fluidity imparting agent and an additive. Further, it is preferable that the toner be subjected to a water-repellency process by affixing to the surfaces of the toner particles hydrophobic particulates, such as hydrophobic silica having a methyl group, and hydrophobic titanium oxide.

Further, the application liquid that has transitioned to a foam preferably will have sufficient hydrophilicity relative to the particles of toner that have undergone water-repellency processing. Here, hydrophilicity signifies the extent of expanded liquid wetting relative to the surface of a solid when a liquid comes in contact with a solid. That is, it is preferable that the foamed application liquid exhibit sufficient wettability relative to the water-repellency treated toner. The surfaces of the toner particles, which have been subjected to water-repellency treatment using hydrophobic particulates like hydrophobic silica and hydrophobic titanium oxide, are covered by methyl groups that exist on the surface of the hydrophobic silica and hydrophobic titanium oxide, and have surface energy of approximately 20 mN/m. Since the entire surface of the water-repellency treated toner particle cannot realistically be completely covered by hydrophobic particulates, the surface energy of the water-repellency treated toner is estimated at approximately 20 to 30 mN/m. Thus, in order for the water-repelling toner to have hydrophilicity (to have sufficient wettability), it is preferable that the surface tension of the foamed application liquid be from 20 to 30 mN/m.

When using an aqueous solvent, adding a surface active agent preferably will make surface tension between 20 and 30 mN/m. Further, in the case of an aqueous solvent, it is preferable that the aqueous solvent comprise either monovalent or polyvalent alcohol. These materials have the advantage of heightening the stability of the air bubbles in the foam application liquid, and making it difficult for the bubbles to burst. For example, setanol or another such monovalent alcohol, or glycerin, propylene glycol, 1, 3 butylene glycol or another such polyvalent alcohol are preferable. Further, comprising either a monovalent or polyvalent alcohol in the aqueous solvent has the effect of preventing curling in the paper or other such medium.

Next, examples of application liquid of the present invention will be explained.

Embodiment 1

<Application Liquid Formulation>

| | | |
|---|---|---|
| Diluent solvent: | Ion exchange water | 53 wt % |
| Softening agent: | Diethoxyethyl succinate (Croda DES by Croda Japan K.K.) | 10 wt % |
| | Propylene carbonate | 20 wt % |
| Thickening agent: | Propylene glycol | 10 wt % |
| Bubble augmentation agent: | Coconut fatty acid diethanol amide (1:1 molar ratio) (MARPON MM by Matsumoto Yushi Seiyaku Co.) | 0.5 wt % |
| Foaming agents: | Amine palmitate | 2.5 wt % |
| | Amine myristate | 1.5 wt % |
| | Amine stearate | 0.5 wt % |
| Dispersing agent: | POE (20) lauryl sorbitan (Rheodol TW-S120V by Kao Corp) | 1 wt % |
| | Polyethylene glycol Monostearate (Emanon 3199 by Kao Corp) | 1 wt % |

Furthermore, the dispersing agents are used to assist solubility in the softening agent diluent solvent.

<Liquid Applying Means: Application Device>

| [Big Bubble Producing Means] | |
|---|---|
| Liquid storage container: | Bottle comprising PET resin |
| Liquid conveying pump: | Tube pump (Tube inner diameter: 2 mm, tube material: silicone Rubber) |
| Conveying channel: | 2 mm inner diameter silicone rubber tube |

Porous sheet for producing big bubbles: #400 stainless steel mesh sheet (roughly 40 μm openings)

[Means for Producing Microbubbles from Big Bubbles]

Inner cylinder of double cylinder is fastened to a rotating shaft, and is rotated by a rotating drive motor. The double cylinder is made from PET resin. The outer cylinder has an inner diameter 10 mm, and is 120 mm long, and the inner cylinder has an outer diameter of 8 mm and is 100 mm long. The number of rotations varies from 1000 rpm to 2000 rpm.

[Application Liquid Providing Means: Applying Means]

The constitution uses means for producing the above-mentioned micro-bubbles, prepares a foam application liquid and supplies this foam application liquid to a blade. The gap between the blade and an application roller can be either 25 μm or 40 μm.

Pressure roller: Sponge roller that has an aluminum alloy roller (ϕ10 mm) core around which is formed a polyurethane foam material (Color Foam EMO by Inoac Corp.) having an outer diameter of Φ50 mm.

Application roller: SUS roller (ϕ30 mm) bake coated with PFA Resin.

Film thickness control blade: A 1 mm-thick plate glass bonded to an aluminum alloy support plate. The glass surface faces the application roller, and the gap between the application roller and the glass surface can be controlled within a range from 10 μm and 100 μm.

Figure 2:
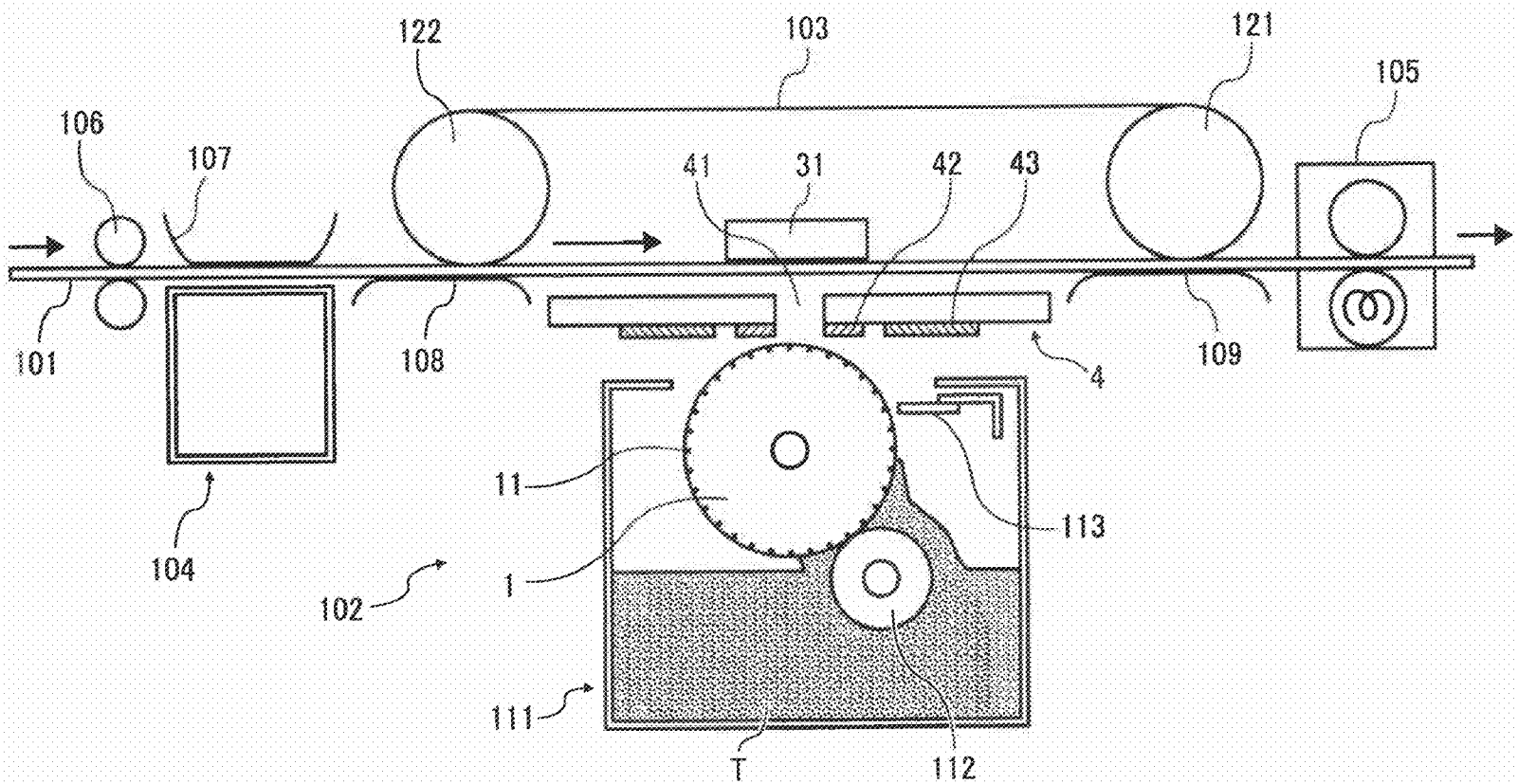
FIG. 2 is a diagram schematically showing the constitution of a first embodiment of an image forming apparatus related to the present invention.

In accordance with the above constitution, image forming is carried out by the image forming apparatus shown in FIG. 2 by applying a control pulse to toner controlling means 4. Toner controlling means 4, which is utilized here, uses the constitution shown in FIG. 10. A liquid conveying pump (liquid transporting means 313) was driven at the conveying timing of recording medium means (recording paper 101), liquid-state application liquid was drawn up from the application liquid container 311, and when the application liquid was made to pass through a member for producing big bubbles and a member for making the bubbles micro sized while passing along the liquid flow channel 312, it was possible to supply a foam application liquid having microbubbles with diameters ranging from 5 μm to 30 μm to the application roller 303 from a liquid discharge opening (supply opening 321), and the apparent density of the foam application liquid was approximately 0.05 g/cm$^3$. As a result, it was ascertained that an extremely high quality image could be produced with no toner spatter even under conditions of 30% ambient humidity, and, at the same time, that the supply energy required for heat fixing was reduced to less then ½ that when an application liquid was not used.

Next, a third example of the application liquid formulation and liquid applying means (application device) will be explained.

Example 1

Application Liquid Formulation

[Liquid Comprising Softening Agent]

| | | |
|---|---|---|
| Diluent solvent: | Ion exchange water | 59 wt % |
| Softening agent: | Diethoxyethyl succinate (Croda DES by Croda Japan K.K.) | 5 wt % |
| Penetrating agent: | Polyether modified silicone (Dow Corning Toray Silicone SS2802) | 1 wt % |
| Thickening agent: | Propylene glycol | 30 wt % |
| Bubble augmentation agent: | Coconut fatty acid diethanol amide | 2 wt % |
| Foaming agent: | Sodium alkylsulfate | 2 wt % |
| pH adjuster: | Triethanolamine | 1 wt % |

The above-mentioned components were mixed and stirred in the above ratios to manufacture a solution.

[Enclosure in High-Pressure Airtight Container]

| | |
|---|---|
| Liquid comprising application liquid: | 95 wt % |
| Liquified gas (LPG): | 5 wt % |

The above-mentioned components were mixed in the above ratios inside an airtight container having an open-air actuator and nozzle to manufacture an O/W emulsion by agitation.

<Liquid Applying Means: Application Device>

Figure 32:
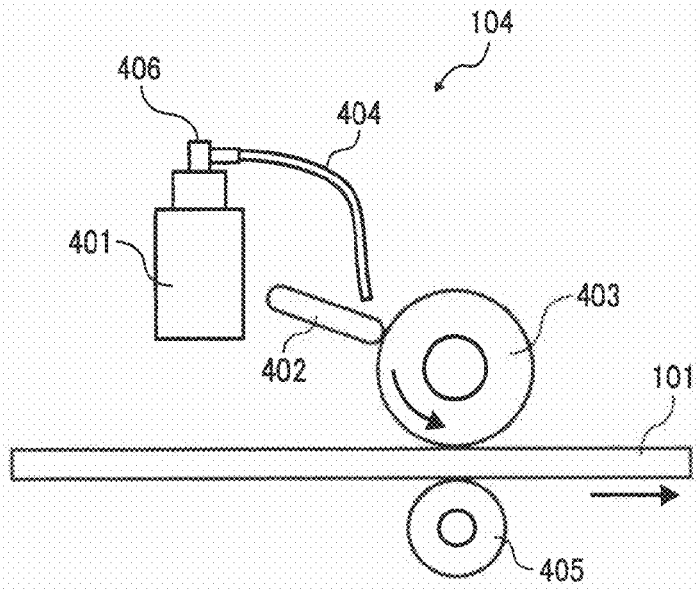
FIG. 32 is a diagram showing a third example of the constitution of either liquid applying means or liquid applying/humidifying means.

As shown in FIG. 32, the constitution is such that the application liquid is mixed together with either a liquefied gas or a compressible gas, and enclosed in this state in an application liquid high-pressure airtight container 401, the application liquid is squirted from the high-pressure airtight container 401 by an actuator 406 and mixed with air bubbles resulting from the expansion of the gas to produce a foam application liquid, and this foam is supplied to a blade 402 by way of a tube 404. The gap between the blade 402 and an application roller 403 is set at 75 μm. Furthermore, a pressure roller 405 is disposed opposite the application roller 403.

The components used here are as follows:

| | |
|---|---|
| Pressure roller: | Aluminum roller (ϕ30 mm) |
| Application roller: | SUS roller (ϕ30 mm) bake coated with PFA Resin |
| Blade: | SUS sheet |
| Paper conveying velocity: | 150 mm/s |
| Weight between pressure roller and application roller: | 196N on one side. |

Then, the application liquid, which had been sprayed from the high-pressure airtight container 401 and made into a foam, was supplied to the gap between the blade 402 and the application roller 403 by way of the tube 404. The apparent density of the foam application liquid was 0.06 g/cm$^3$.

Further, the air bubbles inside the application liquid were distributed within a range of between 30 μm and 100 μm, with most of the air bubbles being within 70 μm of one another, and a plurality of layers of air bubbles were built up on the surface of the application roller.

In accordance with the above constitution, image forming is carried out by the image forming apparatus shown in FIG. 2 by applying a control pulse to toner controlling means 4. Toner controlling means 4, which was utilized here, made use of the constitution shown in FIG. 10. The application liquid, which was sprayed from the high-pressure airtight container 401 at the conveying timing of recording medium means and made into a foam, was supplied the application roller 403. The apparent density of the foam application liquid at this time was approximately 0.05 g/cm$^3$. As a result, it was ascertained that an extremely high quality image could be produced with no toner spatter even under conditions of 30% ambient humidity, and, at the same time, that the supply energy required for heat fixing was reduced to less than ½ compared to when an application liquid is not used.

Figure 33:
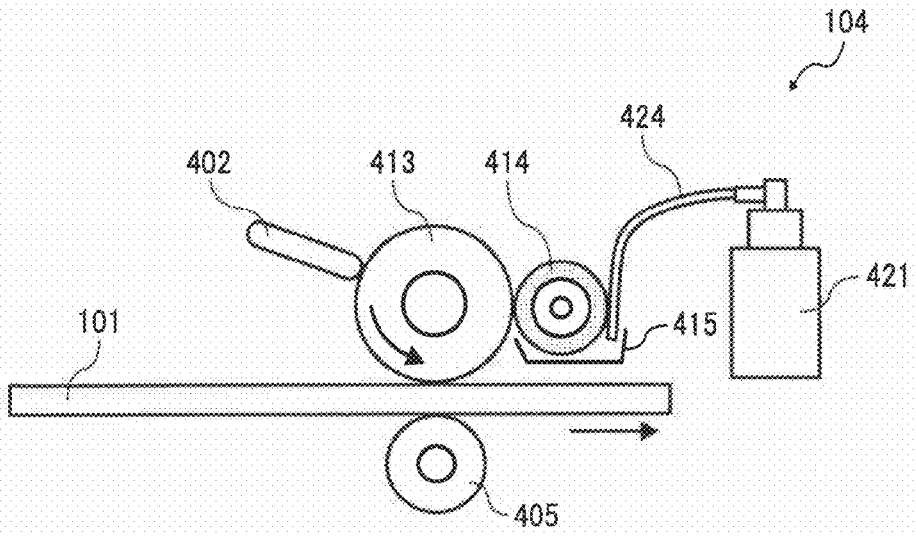
FIG. 33 is a diagram showing a fourth example of the constitution of either liquid applying means or liquid applying/humidifying means.

Next, a fourth example of liquid applying means (the application device) will be explained by referring to FIG. 33.

The surface of the application roller 413 here is porous, and an application liquid impregnation roller 414, which makes contact with this roller 413 and impregnates this roller 413 with the application liquid, is provided. The application liquid impregnation roller 414 coming into contact with the application roller 413 makes it possible to constantly maintain application liquid on the surface of the application roller 413, and the application liquid is applied to recording medium means by the application roller 413 making pressure contact with recording medium means (the recording paper 101).

The application liquid impregnation roller 414 is made by forming a 2 mm- to 3 mm-thick sponge foam layer on the surface of an aluminum roller, makes contact with the foam application liquid, which is stored in a pan 415 below the roller 414, and the application liquid is supplied to the pan 415 via a liquid feed tube 424 from an application liquid storage container 421 based on the detection results of a surface liquid detection sensor not shown in the figure. Furthermore, the application roller 413 is used here, but the constitution can also be such that the application liquid impregnation roller 414 makes direct contact with recording medium means (the recording paper or intermediate transfer recording medium).

Figure 34:
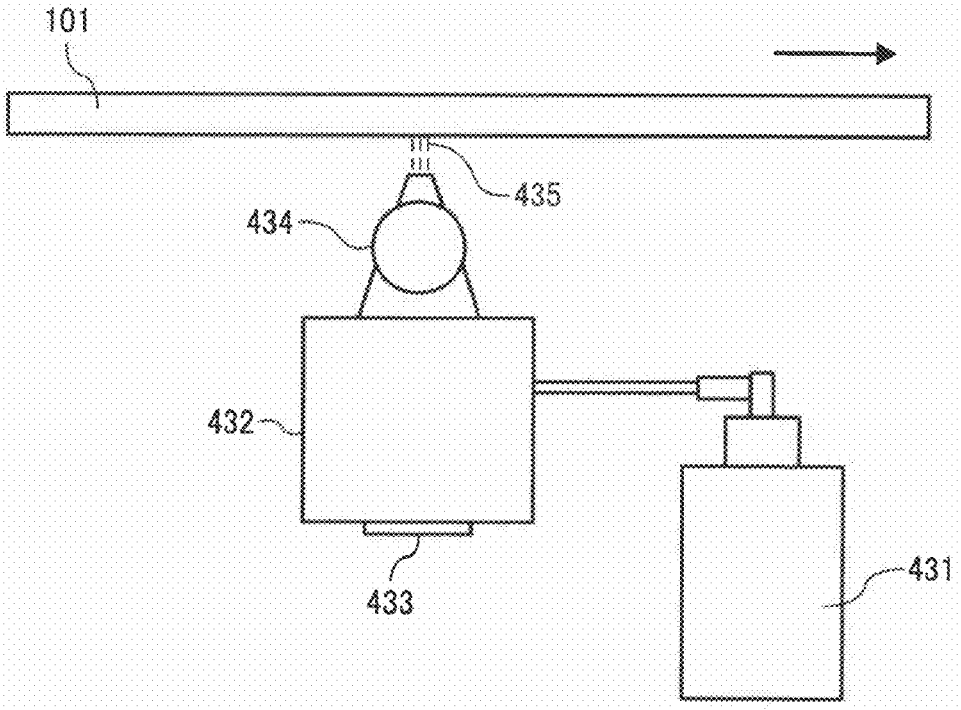
FIG. 34 is a diagram showing a fifth example of the constitution of either liquid applying means or liquid applying/humidifying means.

Next, a fifth example of liquid applying means will be explained by referring to FIG. 34.

Here, the application liquid is supplied to a mist generation tank 432 from an application liquid storage container 431, an application liquid mist is formed in the mist generation tank 432 by an ultrasonic vibrator 433 that uses a PZT, and the application mist is applied to an imaging surface, such as a recording paper 101 by using a blower 434 to spray the mist 435 from below recording medium means (the recording paper 101 or an intermediate transfer recording medium). Furthermore, the supplying of the application liquid from the application liquid storage container 431 to the mist generation tank 432 is carried out based on the detection results of a surface liquid detection sensor not shown in the figure.

By making the constitution such that these liquid applying means only operate when the ambient humidity is low based on the detection results of detecting means for detecting a separately provided ambient humidity, it is possible to realize an efficient image forming apparatus that does not humidify the surface of recording medium means more than necessary.

Further, in the above explanations, the present invention is explained as a constitution that uses the electrical field of a plurality of electrodes disposed on the surface of the toner carrier to make the toner into a cloud and control the flight of the toner, but the present invention is not limited to this, and the same effect can also be achieved with a constitution which directly controls the flight of the toner from the surface of the toner carrier of a toner supply unit in which the toner carrier utilizes either a conventional type two-component recording agent comprising a magnetic carrier and a nonmagnetic toner, or a single-component recording agent comprising a nonmagnetic toner.

Next, a fourth embodiment of the image forming apparatus of the present invention will be explained.

Furthermore, the respective figures referred to in the respective embodiments described hereinabove, and the explanations thereof are substantially similarly applied in this embodiment as well, and the points of this embodiment that differ in particular from the respective embodiments described above will be explained hereinbelow.

In this embodiment, liquid applying/humidifying means 104 for either applying a liquid, such as a water-based, oil-based or other such solvent, to the surface of an intermediate transfer recording medium, which constitutes the imaging surface, or humidifying this surface is provided instead of liquid applying means 104 of the respective embodiments described hereinabove.

That is, liquid applying/humidifying means 104 applies a liquid to the surface of the recording paper 101 (the imaging surface) or subjects the imaging surface to humidification to raise the humidity of the imaging surface, thereby increasing the adhesive force of the toner and imaging surface when the toner collides with the imaging surface, and suppressing and reducing toner spatter. Further, at the same time, the repulsion force of the imaging surface when the toner collides with that surface is reduced, further lessening toner spatter. Furthermore, through experimentation it was ascertained that the application of very small amounts of liquid showed sufficient effect, and that humidification alone without going as far as to apply a liquid also has the effect of sufficiently suppressing toner spatter.

Providing means for either applying a liquid or humidifying a recording medium prior to forming a toner image using a direct recording method like this makes it possible to reduce toner spatter and achieve a good image when the toner image is formed using the direct recording method.

Furthermore, the application liquid formulation in this embodiment is as shown below.

Example 1

| | | |
|---|---|---|
| Diluent solvent: | Ion exchange water | 85 wt % |
| Thickening agent: | Propylene glycol | 10 wt % |
| Bubble augmentation agent: diethanol amide (1:1 molar ratio) (MARPON MM by Matsumoto Yushi Seiyaku Co.) | Coconut fatty acid | 0.5 wt % |
| Foaming agents: | Amine palmitate | 2.5 wt % |
| | Amine myristate | 1.5 wt % |
| | Amine stearate | 0.5 wt % |

Example 2

| | | |
|---|---|---|
| Diluent solvent: | Ion exchange water | 64 wt % |
| Penetrating agent: (Dow Corning Toray Silicone SS2802) | Polyether modified silicone | 1 wt % |
| Thickening agent: | Propylene glycol | 30 wt % |
| Bubble augmentation agent: diethanol amide | Coconut fatty acid | 2 wt % |
| Foaming agent: | Sodium alkylsulfate | 2 wt % |
| pH adjuster: | Triethanolamine | 1 wt % |

The above-mentioned components were mixed and agitated in the above ratios to manufacture a solution.

According to the image forming apparatus related to the present invention, the constitution comprises a toner carrier for carrying the toner, recording medium means to which the toner adheres, and toner controlling means having a plurality of toner passage holes that is disposed between the toner carrier and recording medium means, and a control electrode for controlling toner passage is disposed on the toner carrier side surface of toner controlling means in at least either one of the area surrounding the toner passage hole or the inner wall of the toner passage hole, bias voltage applying means by which a bias voltage is applied so that the toner, which has passed through toner controlling means, adheres to recording medium means is disposed on the recording medium means side of toner controlling means, and also comprises liquid applying means for applying to recording medium means an application liquid comprising a softening agent for softening the above-mentioned toner by either dissolving or swelling the resin in the toner prior to forming a toner image on recording medium means, or liquid applying/humidifying means for either applying a liquid or humidifying recording medium means, thereby reducing toner spatter when using the direct recording method to form a toner image, and, in addition, promoting toner fixing, and achieving a good quality image.

Various modifications will become possible for those skilled in the art after receiving the teachings of the present disclosure without departing from the scope thereof.

What is claimed is:

1. An image forming apparatus comprising:

a toner carrier for carrying toner;

recording medium means to which the toner is made to adhere; and toner controlling means which is disposed between the toner carrier and the recording medium means, and which has a plurality of toner passage holes, wherein a control electrode for controlling the passage of the toner is disposed at least in either an area around the toner passage hole or on an inner wall of the hole on the surface of the toner carrier side of the toner controlling means, and bias voltage applying means for bias voltage application is disposed on the recording medium means side of the toner controlling means so that the toner, which has passed through the toner controlling means, is made to adhere to the recording medium means, the image forming apparatus further comprising:

liquid applying means for applying to the recording medium means an application liquid containing a softening agent for softening the toner by either dissolving or swelling a resin in the toner prior to forming a toner image on the recording medium means.

2. The image forming apparatus according to claim 1, wherein a common electrode that is common to the plurality of toner passage holes is provided on an external side of the control electrode on the toner controlling means, and when setting a state in which the toner of the toner carrier is able to pass through the toner passage hole of the toner controlling means toward the recording medium means, looped lines of electric force are formed between the recording medium means side and the command electrode of the toner controlling means, the looped lines of electric force bypassing the control electrode.

3. The image forming apparatus according to claim 2, wherein the toner carrier comprises means for clouding the toner, and a temporally fluctuating average potential Vs voltage is applied to the means for clouding the toner of the toner carrier, a voltage Vc-on is applied to the control electrode of the toner controlling means when setting a state in which the toner is able to pass through the toner passage hole, a voltage Vc-off is applied to the control electrode of the toner controlling means when setting a state in which the toner is unable to pass through the toner passage hole, and a voltage Vg is applied to the common electrode, and when a bias voltage Vp is applied to the recording medium means side for guiding the toner that has passed through the toner controlling means to the recording medium means and causing the toner to adhere to the recording medium means, relationships of the respective electric potentials when the toner is set to the passage-enabled state are represented by:

$$Vp>Vc\text{-}on>Vs>Vg$$

and the relationship is such that the bias voltage Vp becomes higher on a plus potential side when the toner is negatively charged toner, and the setting is such that the bias voltage Vp becomes higher on a minus potential side when the toner is positively charged toner.

4. The image forming apparatus according to claim 3, wherein a discrete back electrode is disposed in the area around each of the passage holes on the recording medium means side of the toner controlling means, and the same electric potential is applied at all times to the control electrode and discrete back electrode of the toner controlling means.

5. The image forming apparatus according to claim 1, wherein the liquid applying means comprises liquid producing means for producing a foam liquid; film thickness regulating means for regulating a film thickness of the produced foam liquid; and applying means for applying the thickness-regulated foam liquid to a surface of the recording medium means.

6. The image forming apparatus according to claim 5, wherein the foam liquid is in a continuous foam state on the surface of the applying means.

7. The image forming apparatus according to claim 5, wherein the liquid producing means produces foam liquid by applying shearing force to the liquid and causing the liquid to contain air bubbles.

8. The image forming apparatus according to claim 5, wherein the liquid producing means encloses the liquid in a state in which the liquid is mixed together with either a liquefied gas or a compressible gas in an airtight container, and produces a foam liquid by squirting the liquid from the airtight container and allowing the expansion of the gas to include air bubbles in the liquid.

9. The image forming apparatus according to claim 5, wherein the applying means is means for making contact with and applying the foam liquid to the recording medium means, and the film thickness regulating means regulates the film thickness of the foam liquid in accordance with a contact pressure of the applying means relative to the recording medium means.

10. The image forming apparatus according to claim 5, wherein the applying means is either a roller-shaped member or a belt-shaped member.

11. The image forming apparatus according to claim 1, wherein means for either applying a liquid to or humidifying the surface of the recording medium means has an impregnation roller impregnated with a liquid, and causes this impregnation roller to make rotational contact with either an application roller, which comes in contact with the surface of the recording medium means, or the surface of the recording medium means, and applies the liquid to the surface of the recording medium means.

12. The image forming apparatus according to claim 1, wherein means for either applying a liquid to or humidifying the surface of the recording medium means is means for spraying mist on the surface of the recording medium means without making contact therewith.

13. The image forming apparatus according to claim 1, wherein the recording medium means is recording paper.

14. The image forming apparatus according to claim 1, wherein the recording medium means is an intermediate transfer medium, and transfers a toner image formed on the intermediate transfer medium to recording paper.

15. The image forming apparatus according to claim 1, wherein a color image is formed on the recording medium means by applying different colors of the toner.

16. An image forming apparatus, comprising:

a toner carrier for carrying toner;

recording medium means to which the toner is made to adhere; and toner controlling means which is disposed between the toner carrier and the recording medium means, and which has a plurality of toner passage holes, wherein a control electrode for controlling the passage of the toner is disposed at least in either an area around the toner passage hole or on an inner wall of the hole on a surface of a toner carrier side of the toner controlling means, and bias voltage applying means for bias voltage application is disposed on the recording medium means side, so that the toner, which has passed through the toner controlling means, is made to adhere to the recording medium means, the image forming apparatus further comprising:

means for either applying a liquid to or humidifying the recording medium means prior to forming a toner image on the recording medium means.

* * * * *